US006698280B1

(12) United States Patent
Iden et al.

(10) Patent No.: US 6,698,280 B1
(45) Date of Patent: Mar. 2, 2004

(54) FAILURE TEST APPARATUS FOR FUEL-VAPOR PURGING SYSTEM

(75) Inventors: Noriyuki Iden; Tokiji Ito; Yuichi Kohara; Shuichi Hanai; Shin Adachi, all of Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/523,362

(22) Filed: Mar. 10, 2000

(30) Foreign Application Priority Data

Apr. 1, 1999 (JP) ..... 11-094995
Jun. 23, 1999 (JP) ..... 11-177429

(51) Int. Cl.[7] ..... F02M 25/08
(52) U.S. Cl. ..... 73/118.1
(58) Field of Search ..... 73/40, 49.2, 49.7, 73/118.1, 115; 701/31; 123/519, 520

(56) References Cited

U.S. PATENT DOCUMENTS 5,261,379 A * 11/1993 Lipinski et al. ..... 123/520
5,327,873 A * 7/1994 Ohuchi et al. ..... 123/520
5,443,051 A * 8/1995 Otsuka ..... 123/520
5,445,015 A * 8/1995 Namiki et al. ..... 73/118.1
5,448,980 A * 9/1995 Kawamura et al. ..... 123/520
5,669,362 A * 9/1997 Shinohara et al. ..... 123/520
6,082,337 A * 7/2000 Fujimoto et al. ..... 123/520

FOREIGN PATENT DOCUMENTS

JP 5-180101 7/1993

* cited by examiner

*Primary Examiner*—George Dombroske
(74) *Attorney, Agent, or Firm*—Oliff & Berridge, PLC

(57) ABSTRACT

A failure test apparatus for a fuel-vapor purging system for adsorbing fuel vapor in a fuel tank into a canister and for purging fuel to an intake system of an internal combustion engine as needed. The purging system has at least one valve. A first test unit provides a differential pressure between the inside and the outside of the fuel-vapor purging system, measures the internal pressure with the fuel-vapor purging system in an airtight condition, and determines whether a leak exists in the fuel-vapor purging system from the behavior of the internal pressure. The test by the first test unit involves a differential-pressure forming process of creating a differential pressure between the inside and the outside of the fuel-vapor purging system, a sealing process of making the fuel-vapor purging system airtight when the differential pressure exists, and a differential-pressure releasing process for releasing the differential pressure. In association with one or more of the processes, a second test unit measures the internal pressure of the fuel-vapor purging system to detect a failure in any valve actuated in one of the processes based on the behavior of the internal pressure.

19 Claims, 14 Drawing Sheets

FAILURE TEST APPARATUS FOR FUEL-VAPOR PURGING SYSTEM

BACKGROUND OF THE INVENTION

The present invention relates to a failure test apparatus for a fuel-vapor purging system, which is used for internal combustion engines of vehicles.

There is a known fuel-vapor purging system that causes fuel vapor to be temporarily adsorbed by adsorbents in a canister. Fuel that is adsorbed while a vehicle is running is purged, into the intake system to prevent fuel evaporated in the fuel tank from escaping into the air. In such a fuel-vapor purging system, if there is a hole is in the purge pipe or if the pipe comes off for some reason, fuel leaks and escapes into the air from the canister or the fuel tank. It is therefore necessary to automatically detect whether there is a leak.

An existing system provides a differential pressure between the inside and outside of the fuel-vapor purging system and monitors the behavior of the internal pressure to detect the presence of a leak. For instance, intake vacuum pressure is applied to the fuel-vapor purging system, and then the intake and discharge passages are closed by valves, which makes the fuel-vapor purging system airtight. Then, the internal pressure in the fuel-vapor purging system is measured to determine whether the system is sealed.

The aforementioned intake and discharge passage valves may be the source of a failure. If a valve failure occurs, purging may not be performed properly or fuel vapor may escape into the air from the air-inlet port of the canister. Compared to a hole in the system, a valve failure has a different effect on the internal pressure of the fuel-vapor purging system, and the previously described leak test cannot be used to detect a valve failure.

With regard to a valve failure, conventionally, vacuum pressure is applied to the fuel-vapor purging system through the intake system of an internal combustion engine solely for testing the valves, and the behavior of the internal pressure in this system is checked to detect a valve failure (Japanese Unexamined Patent Publication (KOKAI) No. Hei 5-180101).

However, performing of two kinds of tests, one for holes and one for valve failure, requires that the sequence of applying vacuum pressure to the fuel-vapor purging system, disabling purging, and enabling purging be repeated at least twice. This varies the air-fuel ratio in the intake system over a relatively long period of time. This may result in heavy emissions over a relatively long period of time.

SUMMARY OF THE INVENTION

Accordingly, it is an object of the present invention to provide a failure test apparatus for a fuel-vapor purging system that reduces air-fuel ratio variation caused by the testing.

To achieve the foregoing and other objectives and in accordance with the purpose of the present invention, a failure test apparatus for a fuel-vapor purging system is provided. The fuel-vapor purging system adsorbs fuel vapor in a fuel tank into a canister and purges fuel in the canister to an intake system of an internal combustion engine as needed. The system has at least one valve. The apparatus includes first test means and second test means. The first test means provides a differential pressure between the inside and the outside of the fuel-vapor purging system. The first test means measures the internal pressure with the fuel-vapor purging system when in an airtight condition and determines whether a leak exists in the fuel-vapor purging system from the behavior of the internal pressure. The determination by the first test means includes a differential-pressure forming process of creating a differential pressure between the inside and the outside of the fuel-vapor purging system, a sealing process for making the fuel-vapor purging system airtight when the differential pressure exists, and a differential-pressure releasing process for releasing the differential pressure. The second test means measures the internal pressure of the fuel-vapor purging system in association with one or more of the processes to thereby detect a failure in the valve based on the behavior of the internal pressure.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

First Embodiment

Figure 1:
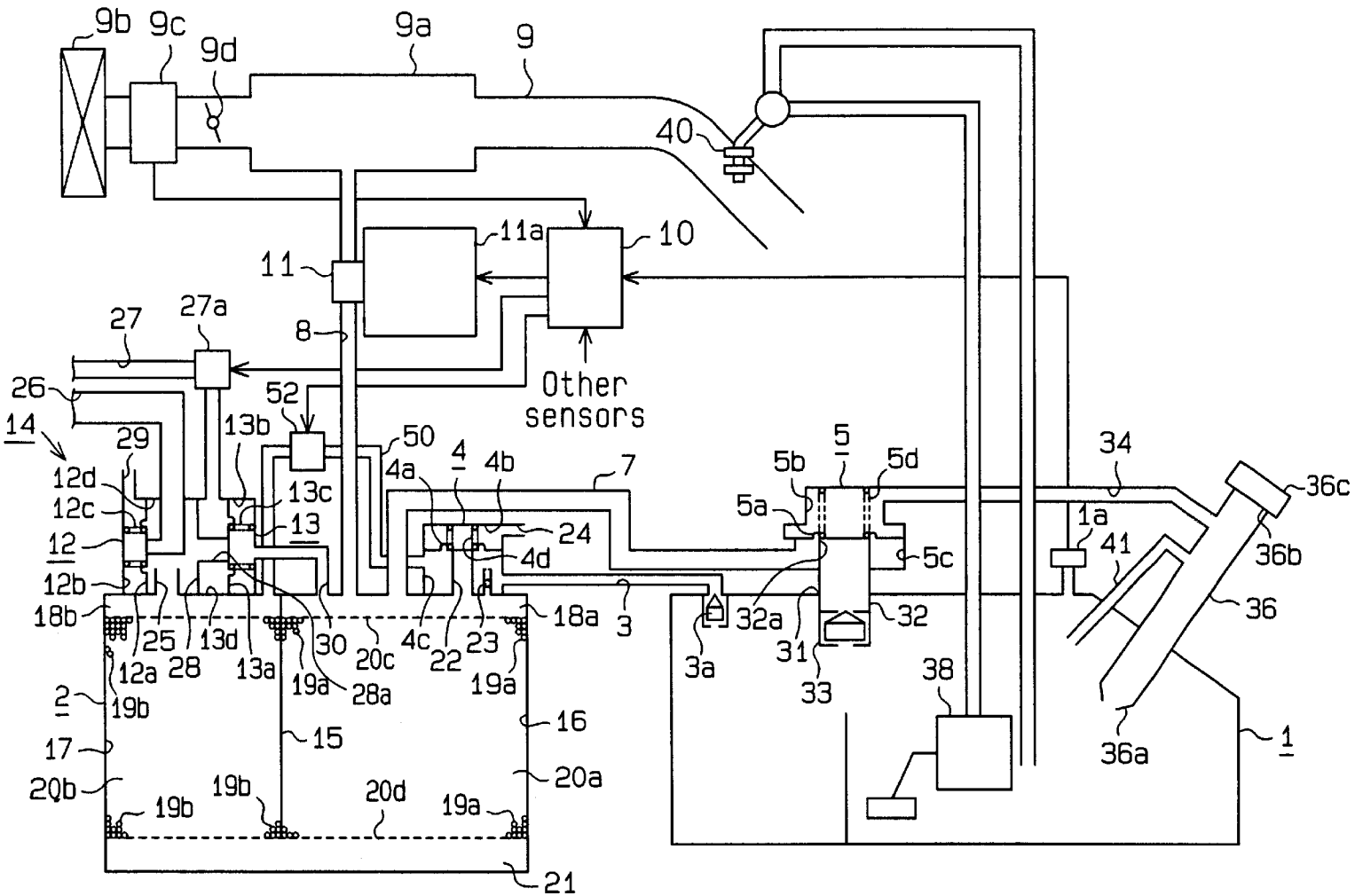
FIG. 1 is a diagram illustrating the general structure of a fuel-vapor purging system according to a first embodiment.
Figure 2:
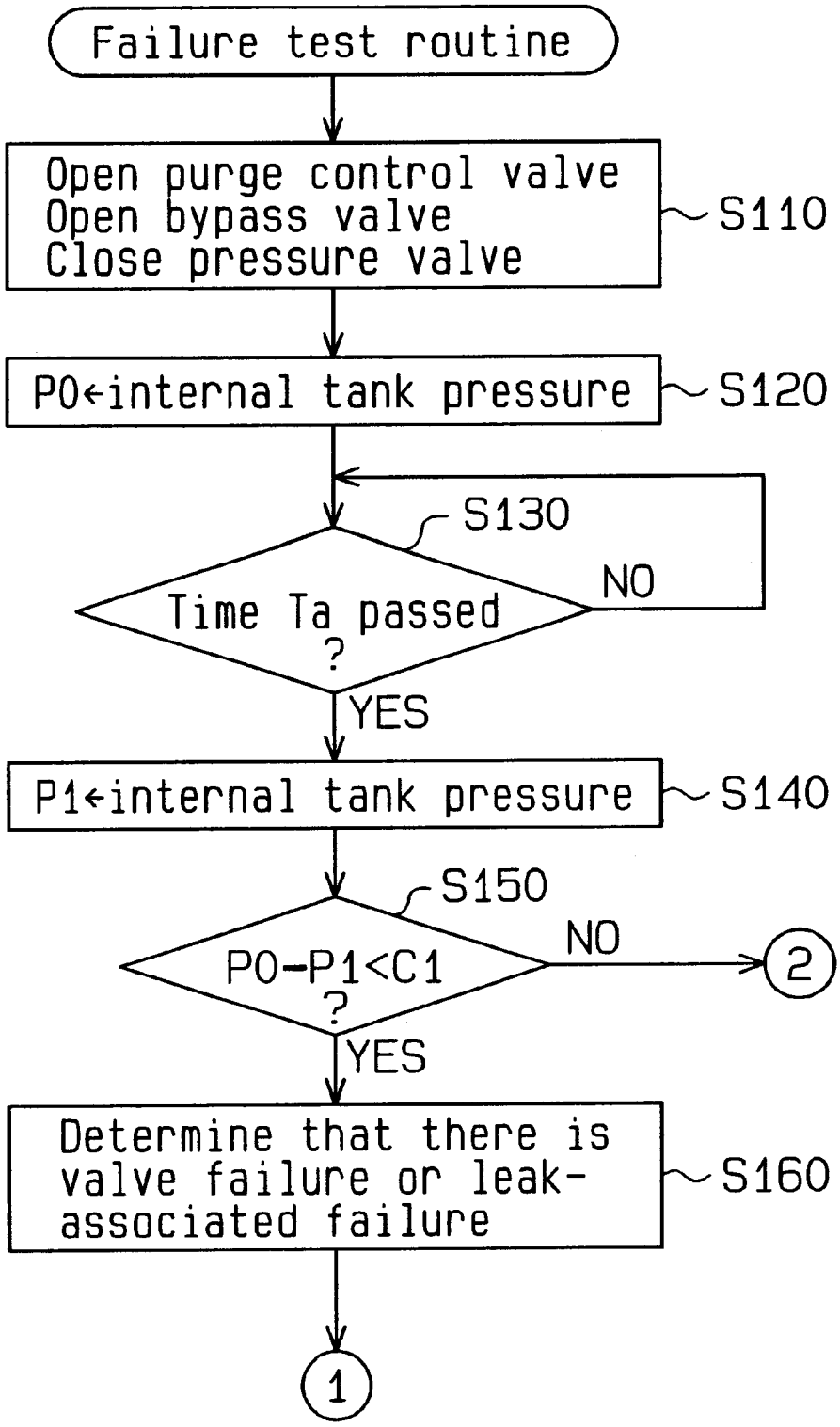
FIG. 2 is a flowchart illustrating part of a failure test routine according to the first embodiment.

FIG. 1 is a schematic diagram illustrating a gasoline vapor purging system according to a first embodiment. This fuel-vapor purging system is attached to a vehicle engine.

One end of a passage 3 is connected via a float valve 3*a* to a fuel tank 1 of a gasoline engine for leading fuel vapor generated inside the fuel tank 1 into a canister 2. The other end of the passage 3 is connected to the canister 2 via a tank-pressure control valve 4 provided at the upper portion of the canister 2. This control valve 4 is designed to open when the internal pressure in the fuel tank 1 becomes equal to or greater than a specific value.

The fuel tank 1 is provided with a differential-pressure regulating valve 5, which opens during refueling. This differential-pressure regulating valve 5 is connected to the canister 2 by a breather passage 7. When the differential-pressure regulating valve 5 opens during refueling, therefore, the fuel vapor in the fuel tank 1 is led into the canister 2 through the breather passage 7.

The interior of the canister 2 is connected to a surge tank 9*a*, which is a part of an air-intake passage 9 of the engine, by a purge passage 8 that is provided with a purge control valve 11. The purge control valve 11 is opened or closed by a drive circuit 11*a* based on a control signal from an ECU (Electronic Control Unit) 10, which is a microcomputer.

For example, the purge control valve 11 adjusts the amount of fuel (purge flow rate) to be supplied to the air-intake passage 9 of the engine from the canister 2 during purging and closes or opens the purge passage 8 during testing. A vacuum switching valve (VSV) or the like, for example, is used as the purge control valve 11.

The interior of the canister 2 is separated into two chambers by a partition 15. The two chambers are a main chamber 16 in which a tank-pressure control valve 4 is provided and a sub chamber 17 in which an atmosphere-side control valve 14 is provided. The sub chamber 17 has a smaller inner volume than the main chamber 16. Air layers 18*a* and 18*b* are respectively formed at one ends of the main chamber 16 and sub chamber 17, and adsorbent layers 20*a* and 20*b* filled with activated carbon adsorbent 19*a* and 19*b* are respectively formed adjacent to the air layers 18*a* and 18*b*.

The activated carbon adsorbent 19*a* and 19*b* is located between filters 20*c* and 20*d*. The space adjacent to the filter 20*d* is a diffusion chamber 21, which connects the main chamber 16 to the sub chamber 17.

A vapor inlet port 22 for leading the fuel vapor generated in the fuel tank 1 into the canister 2 is formed in the upper end surface of the canister 2 on the side where the main chamber 16 is located. Formed in the vicinity of the vapor inlet port 22 is a check-ball type vapor relief valve 23 for ventilation when the pressure in the fuel tank 1 becomes negative.

The tank-pressure control valve 4 is provided on the upper end surface of the canister 2 to cover the vapor inlet port 22. The tank-pressure control valve 4 has a diaphragm 4*a*, which closes the distal opening of the vapor inlet port 22. The diaphragm 4*a* separates the inside of the tank-pressure control valve 4 into two pressure chambers. On one side of the diaphragm 4*a* is a back pressure chamber 4*b*, and a positive pressure chamber 4*c* is located on the opposite side. Formed in the side wall of the back pressure chamber 4*b* is an open port 24 for keeping the interior of that chamber at atmospheric pressure. The interior of the positive pressure chamber 4*c* is connected via the passage 3 to the interior of the fuel tank 1.

As the diaphragm 4*a* is pressed toward the distal opening of the vapor inlet port 22 by the force of a spring 4*d*, which is in the back pressure chamber 4*b*, the tank-pressure control valve 4 is held closed until the pressure in the fuel tank 1 reaches to a specific pressure or higher.

One end of the breather passage 7 is connected to the upper end surface of the canister 2 on the side where the main chamber 16 is located. The purge passage 8 is likewise connected to the main chamber 16 in the vicinity of the opening of the breather passage 7.

A ventilation port 25 for permitting air to flow into the canister 2 is formed in the upper end surface of the canister 2 on the side where the sub chamber 17 is located. The atmosphere-side control valve 14 regulates the ventilation port 25. The atmosphere-side control valve 14 is formed by a release control valve 12 and a suction control valve 13 that face each other.

An atmospheric pressure chamber 12*b* is formed on one side of a diaphragm 12*a*, which is part of the release control valve 12, and a negative pressure chamber 13*b* is formed on one side of a diaphragm 13*a*, which is part of the suction control valve 13. The space between the two diaphragms 12*a* and 13*a* is separated into two pressure chambers by a partition 28. One of the chambers is a positive pressure chamber 12*d* while the other one is an atmospheric pressure chamber 13*d*.

Formed in the partition 28 is a pressure port 28*a*, the distal opening of which can be closed by the diaphragm 13*a*. An intake passage 27 is connected to the atmospheric pressure chamber 13*d*. Since the diaphragm 13*a* is pressed toward the distal opening of the pressure port 28*a* by the force of a spring 13*c*, which is disposed in the negative pressure chamber 13*b*, the suction control valve 13 is normally held closed. Connected to the negative pressure chamber 13*b* is a pressure passage 30, which connects the interior of chamber 13*b* to the interior of the main chamber 16 of the canister 2, so that the pressure generated in the purge passage 8 is applied to the negative pressure chamber 13*b*.

When fuel adsorbed in the canister 2 is purged (discharged) to the air-intake passage 9 by the negative pressure generated in the surge tank 9*a*, the suction control valve 13 opens when the differential pressure between the intake pressure that acts on the negative pressure chamber 13*b* via the pressure passage 30 and the atmospheric pressure on the side of the atmospheric pressure chamber 13*d* reaches a specific pressure difference. This permits outside air to flow into the canister 2 from the sub chamber 17 via the pressure port 28*a* and the ventilation port 25. The outside air causes the fuel vapor adsorbed by the activated carbon adsorbents 19*a* and 19*b* in the main chamber 16 and sub chamber 17 to flow through the purge passage 8 to enter the intake air that flows in the surge tank 9*a*.

A pressure valve 27*a*, which is located in the intake passage 27, is normally open. If a failure is reported, however, the ECU 10 controls the opening/closing action of the pressure valve 27*a*, which will be discussed later. The pressure valve 27*a* is a VSV or the like, for example.

An open port 29 which communicates with the atmospheric pressure chamber 12*b* of the release control valve 12 is formed in the atmosphere-side control valve 14 so that the pressure in the atmospheric pressure chamber 12*b* is always equal to the atmospheric pressure. Provided in the atmosphere-side control valve 14 is a release passage 26, which conducts gas, from when the fuel has been removed, to the atmosphere. In an ORVR (Onboard Refueling Vapor Recovery) process, a large amount of air (gas from which the fuel vapor has been recovered) is discharged via the release passage 26. Therefore, the release passage 26 has substantially the same cross-sectional area as the breather passage 7. The entrance opening of the release passage 26 is normally closed by the diaphragm 12*a* of the release control valve 12. The diaphragm 12*a* is pressed toward the opening of the release passage 26 by the force of a spring 12*c*, which is located in the atmospheric pressure chamber 12*b*. Therefore, the release control valve 12 is closed until the internal pressure of the canister 2 reaches a specific pressure.

When pressure is applied to the inside of the canister 2 from the breather passage 7 during refueling, therefore, the pressure in the positive pressure chamber 12*d* of the release control valve 12 rises. The release control valve 12 is opened when the differential pressure between the pressure in the positive pressure chamber 12*d* and the atmospheric pressure in the atmospheric pressure chamber 12*b* reaches a specific level. As a result, gas, from which the fuel vapor has been removed by adsorption in the main chamber 16 and sub chamber 17, is discharged to the atmosphere via the ventilation port 25 and the release passage 26.

An opening 31 is formed in the top of the fuel tank 1, and a cylindrical breather pipe 32, which is a part of the breather passage 7, is securely fitted in the opening 31. A float valve 33 is formed at the lower end of the breather pipe 32. The differential-pressure regulating valve 5 is provided at the top of the fuel tank 1 to cover an opening 32*a* formed in the upper end of the breather pipe 32. The interior of the differential-pressure regulating valve 5 is separated by a diaphragm 5*a* into upper and lower chambers. A first pressure chamber 5*b* is located above the diaphragm 5*a* and a second pressure chamber 5*c* located below the diaphragm 5*a*. The diaphragm 5*a* is pressed toward the opening 32*a* in the upper end of the breather pipe 32 by the force of a spring 5*d*, which is located in the first pressure chamber 5*b*. As apparent from the above, the diaphragm 5*a* can close the opening 32*a* in the upper end of the breather pipe 32.

The first pressure chamber 5*b* of the differential-pressure regulating valve 5 is connected through a pressure passage 34 to the upper portion of a fuel feeding pipe 36 provided in the fuel tank 1. A restriction 36*a* is formed at the lower end of the fuel feeding pipe 36. When entering fuel passes this restriction 36*a*, the flow direction of the fuel vapor in the fuel feeding pipe 36 is restricted to the direction toward the fuel tank 1 from a refuel port 36*b*. This prevents fuel vapor from escaping to the atmosphere from the refuel port 36*b*. A recirculation line pipe 41, which connects the upper portion of the fuel tank 1 to the upper portion of the fuel feeding pipe 36, permits circulation of the fuel vapor in the fuel tank 1 between the tank 1 and the fuel feeding pipe 36 during refueling, which ensures smooth refueling.

Provided at the top of the fuel tank 1 is a pressure sensor 1*a* for detecting the pressure in the fuel tank 1. A detection signal is sent by the pressure sensor 1*a* to the ECU 10, which controls purging and testing. Signals from various kinds of sensors, such as an air flow meter 9*c* provided in the air-intake passage 9, are likewise sent to the ECU 10.

Further, a bypass passage 50 extends from the positive pressure chamber 4*c* in a tank-pressure control valve 4 to the sub chamber 17 of the canister 2. The bypass passage 50 is therefore connected to the fuel tank 1 and the canister 2 via the positive pressure chamber 4*c* and the passage 3. A bypass valve 52 is located in the bypass passage 50. The ECU 10 controls the actuation of the bypass valve 52, which is normally closed, during failure testing to open or close the bypass passage 50. A VSV or the like serves as the bypass valve 52.

The fuel-vapor purging system having the above-described structure operates as follows.

When fuel is evaporated in the fuel tank 1 and the internal pressure in the fuel tank 1 rises to or above a specific pressure value, the tank-pressure control valve 4 opens. Consequently, fuel vapor flows toward the canister 2 from the fuel tank 1 in the passage 3. The fuel vapor in the fuel tank 1 is therefore led toward the canister 2 via the tank-pressure control valve 4. Because the internal pressures of the first pressure chamber 5*b* and second pressure chamber 5*c* of the differential-pressure regulating valve 5 are equal, the differential-pressure regulating valve 5 is held closed. This closes the breather passage 7.

The fuel component of the fuel vapor that has entered the canister 2 via the passage 3 is recovered by the adsorbent 19*a* in the main chamber 16. Then, the fuel vapor passes through the adsorbent layer 20*a* and reaches the diffusion chamber 21. Further, the fuel vapor passes through the diffusion chamber 21 and enters the sub chamber 17 where fuel that was not recovered by the adsorbent layer 20*a* in the main chamber 16 is captured. Since the fuel vapor flows along the U-shaped path in the canister 2, the time it contacts the adsorbents 19*a* and 19*b* of the adsorbent layers 20*a* and 20*b* is extended, so that the fuel is effectively recovered.

The resulting gas, the fuel of which has mostly been recovered by the adsorbents 19*a* and 19*b* of the adsorbent layers 20*a* and 20*b*, is discharged to the atmosphere through the release passage 26 as the release control valve 12 is opened. At this time, the internal pressure of the negative pressure chamber 13*b* of the suction control valve 13 is a positive pressure greater than the internal pressure of the atmospheric pressure chamber 13*d*, so that the suction control valve 13 does not open. The fuel vapor therefore cannot leak outside through the intake passage 27 via the suction control valve 13.

At times, such as when the vehicle has been parked for a long time, the fuel tank 1 cools, which stops the production of fuel vapor in the fuel tank 1, and the pressure in the fuel tank 1 falls below that in the canister 2 by a predetermined pressure or more, and the pressure in the positive pressure chamber 4*c* of the tank-pressure control valve 4 becomes negative. This causes the check ball of the vapor relief valve 23 (back purge valve) to move upward, thus opening the valve 23. Accordingly, the fuel vapor in the canister 2 is returned (purged back) to the fuel tank 1 via the passage 3. That is, this passage 3 also serves as a back purge passage to return the fuel vapor in the canister 2 into the fuel tank 1. This back purging prevents the fuel tank 1 from being deformed by a pressure drop in the fuel tank 1.

The fuel that has been recovered in the canister 2 is purged to the air-intake passage 9 in the following manner. When the engine is operating, the pressure in the vicinity of the opening of the purge passage 8 on the surge tank (9*a*) side of the valve 11 becomes negative. When the purge control valve 11 is opened by a control signal from the ECU 10, fuel vapor flows toward the surge tank 9*a* from the canister 2 in the purge passage 8.

As a result, the internal pressure of the canister 2 becomes negative and the suction control valve 13 opens to let air come into the canister 2 from the sub chamber 17 via the intake passage 27. Then, the fuel adsorbed by the adsorbents 19*a* and 19*b* is separated and is absorbed by the air.

Air that has been introduced this way carries the fuel vapor to the purge passage 8 and into the surge tank 9*a* via the purge control valve 11. In the surge tank 9*a*, the fuel vapor is mixed with the intake air that has passed through an air cleaner 9*b*, the air flow meter 9*c* and a throttle valve 9*d* and is supplied to the cylinders (not shown). The air-fuel mixture is supplied together with fuel injected from a fuel injection valve 40 via a fuel pump 38 into each cylinder to be burned.

A description will now be given of a failure test routine the ECU 10 executes on the fuel-vapor purging system. FIGS. 2 through 8 illustrate flowcharts for the failure test routine. One example of the routine is illustrated in a timing chart in FIG. 9. In the flowcharts, "S" followed by a number indicates a step number.

After the necessary initialization is performed when the ECU 10 is powered on and after execution conditions for the failure test routine are met, the failure test routine is initiated. The execution conditions are provided to determine whether or not the intake vacuum pressure can be applied to the fuel-vapor purging system for failure testing. For example, two execution conditions are that the pressure sensor 1*a* or other sensors are working and a certain time has passed since the engine has started.

When the execution conditions for the failure test routine are satisfied and the failure test routine is initiated, first, the purge control valve 11 is opened, the bypass valve 52 is opened and the pressure valve 27*a* is closed (S110). Since the pressure valve 27*a* is closed, the outside air does not come into the fuel-vapor purging system. As the purge control valve 11 is open, the negative pressure in the surge tank 9*a* is applied to the canister 2 from the purge passage 8. Since the bypass valve 52 is open, negative pressure is applied to the fuel tank 1 through the canister 2, the bypass passage 50, the positive pressure chamber 4*c* of the tank-pressure control valve 4 and the passage 3.

Figure 9:
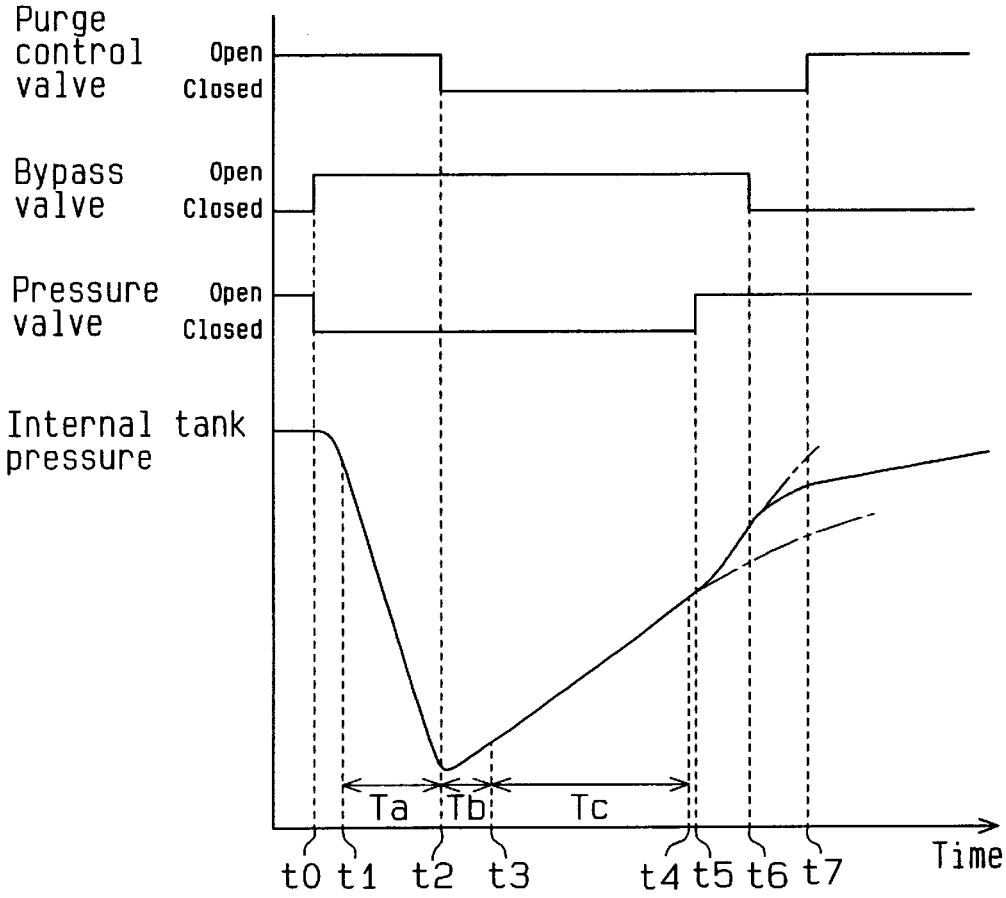
FIG. 9 is a timing chart representing the relationship among the internal pressure of a fuel tank and the positions of the individual valves during testing.

After negative pressure is applied to the fuel-vapor purging system at time to, therefore, the internal pressure of the fuel tank 1, which is detected by the pressure sensor 1*a*, falls rapidly, as shown in FIG. 9.

Next, after passage of a preset time (time t1 in FIG. 9), the internal tank pressure is stored as a variable P0 in the RAM area in the ECU 10 (S120). It is then determined whether a time Ta has passed since the detected pressure value from the pressure sensor 1*a* was stored in step S120 (S130). If the time Ta has not passed yet (NO in S130), the decision in step S130 is repeated.

When the time Ta has passed (YES in S130; time t2), the current internal tank pressure is stored as a variable P1 also set in the RAM area in the ECU 10 (S140). Then, it is determined if the change (P0−P1) in the internal tank pressure at time Ta is less than a decision value C1 (S150). This decision value C1 is a reference for determining whether the fuel-vapor purging system is sufficiently sealed from outside and whether the negative pressure from the purge passage 8 is applied to the canister 2 and the fuel tank 1 at a sufficient rate. Therefore, P0−P1<C1 if the negative pressure has not yet been sufficiently applied to the fuel tank 1 at time Ta or the rate of pressure drop in the tank 1 is out of the normal range.

The following four states or combinations thereof are possible states where the internal tank pressure does not have a sufficient rate of fall.

(1) Although the ECU 10 instructed that the purge control valve 11 be opened, the purge control valve 11 is not open, which prevents application of negative pressure to the fuel tank 1.

(2) Although the ECU 10 instructed that the pressure valve 27*a* be closed, the pressure valve 27*a* is not closed, and outside air is flowing into the canister 2 via the intake passage 27 and the suction control valve 13, which results in an insufficient rate of pressure decrease in the tank.

(3) Although the ECU 10 instructed that the bypass valve 52 be opened, the bypass valve 52 is not open, which prevents application of negative pressure to the fuel tank 1 via the bypass passage 50 even if sufficient vacuum is applied to the canister 2.

(4) A relatively large hole is present in the fuel-vapor purging system and a large amount of air is entering through that hole, and the rate of decrease of the internal tank pressure is insufficient.

When P0−P1<C1 (YES in S150), therefore, it is determined that the purge control valve 11, the pressure valve 27*a*, the bypass valve 52 or a combination of these valves has failed or there is a relatively large hole (S160) in the system. Then, failure flags in the RAM in the ECU 10 for the purge control valve 11, the pressure valve 27*a* and the bypass valve 52 are set and a failure flag indicating a leak is also set.

Figure 8:
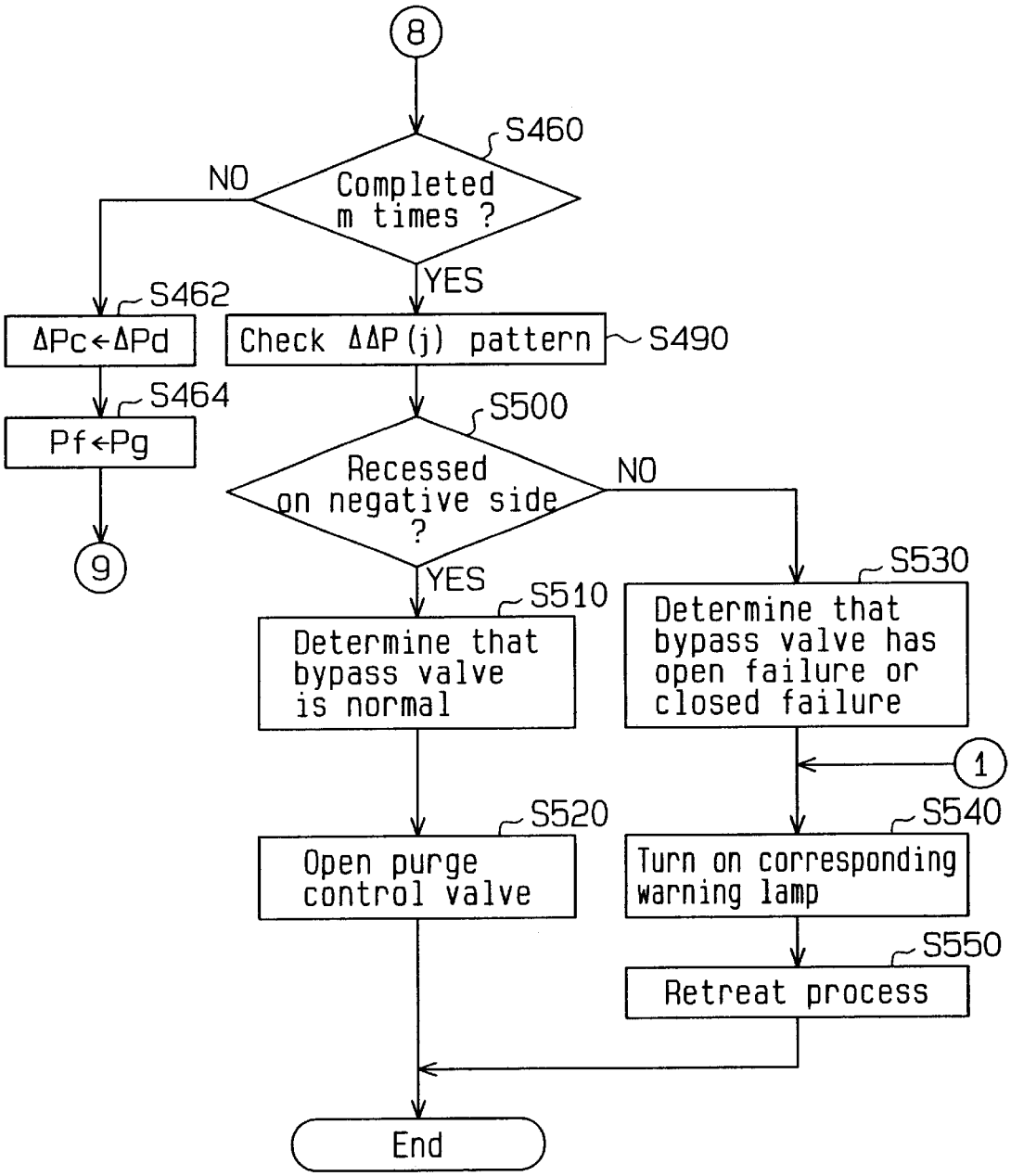
FIG. 8 is a flowchart illustrating part of the failure test routine.

According to the state of the failure flags, as shown in FIG. 8, corresponding warning lamps on the instrument panel in the vehicle are lit (S540), a retreat process is carried out (S550) and the failure test routine is then terminated. The retreat process promptly stops the application of negative pressure to the fuel-vapor purging system and inhibits the further application of negative pressure.

Figure 3:
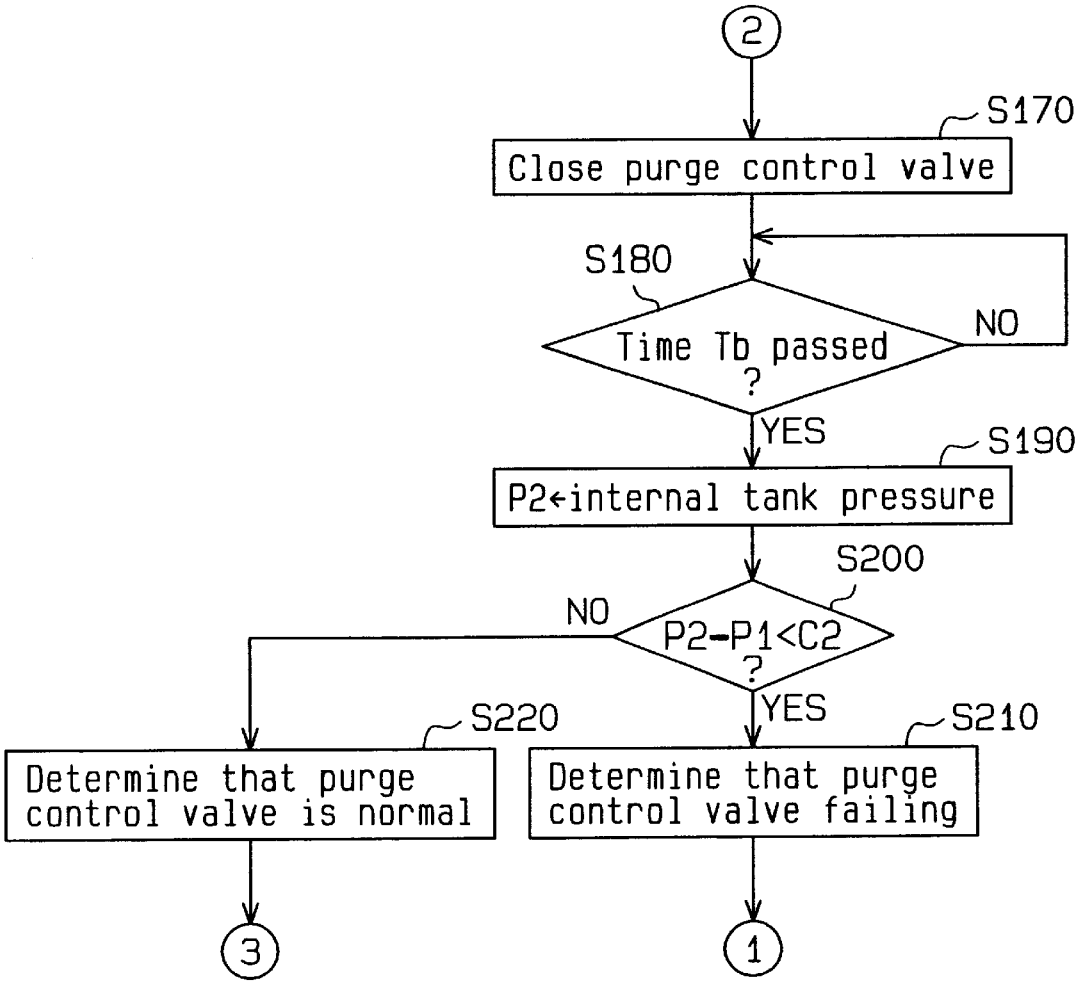
FIG. 3 is a flowchart illustrating part of the failure test routine.

When P0−P1≧C1 (NO in S150), the ECU 10 then instructs complete closure of the purge control valve 11 as shown in FIG. 3 (S170). This stops the application of negative pressure from the purge passage 8 and completely seals the fuel-vapor purging system. As a result, the internal tank pressure stops falling and starts to gradually rise due to the pressure of the fuel vapor (at and after time t2). Then, it is determined in step S170 whether a time Tb has passed since the purge control valve 11 (S180) was closed. If the time Tb has not passed (NO in S180), step S180 is repeated.

When the time Tb has passed (YES in S180; time t3), the internal tank pressure is stored as a variable P2 in the RAM area in the ECU 10 (S190). Then, it is determined whether the change (P2−P1) in the internal tank pressure at time Tb is less than a decision value C2 (S200). This decision value C2 is a reference for determining whether the fuel-vapor purging system is completely sealed so that no further pressure drop occurs and the pressure gradually rises due to the vapor pressure.

If the purge control valve 11 is not completely closed in step S170, then P2−P1<C2 (YES in S200). That is, the internal tank pressure lies out of the normal variation range. It is therefore determined that the purge control valve 11 has remained open and is failing (S210).

Specifically, the failure flag for the purge control valve 11 is set. Accordingly, the corresponding warning lamp on the instrument panel in the vehicle is lit (S540), the retreat process is carried out (S550) and the failure test routine is terminated, as mentioned above.

When P2−P1≧C2 (NO in S200), the ECU 10 determines that the purge control valve 11 is not failing but is normal (S220). Specifically, the ECU 10 sets a normal flag that indicates that the test of the purge control valve 11 has been terminated properly.

Figure 4:
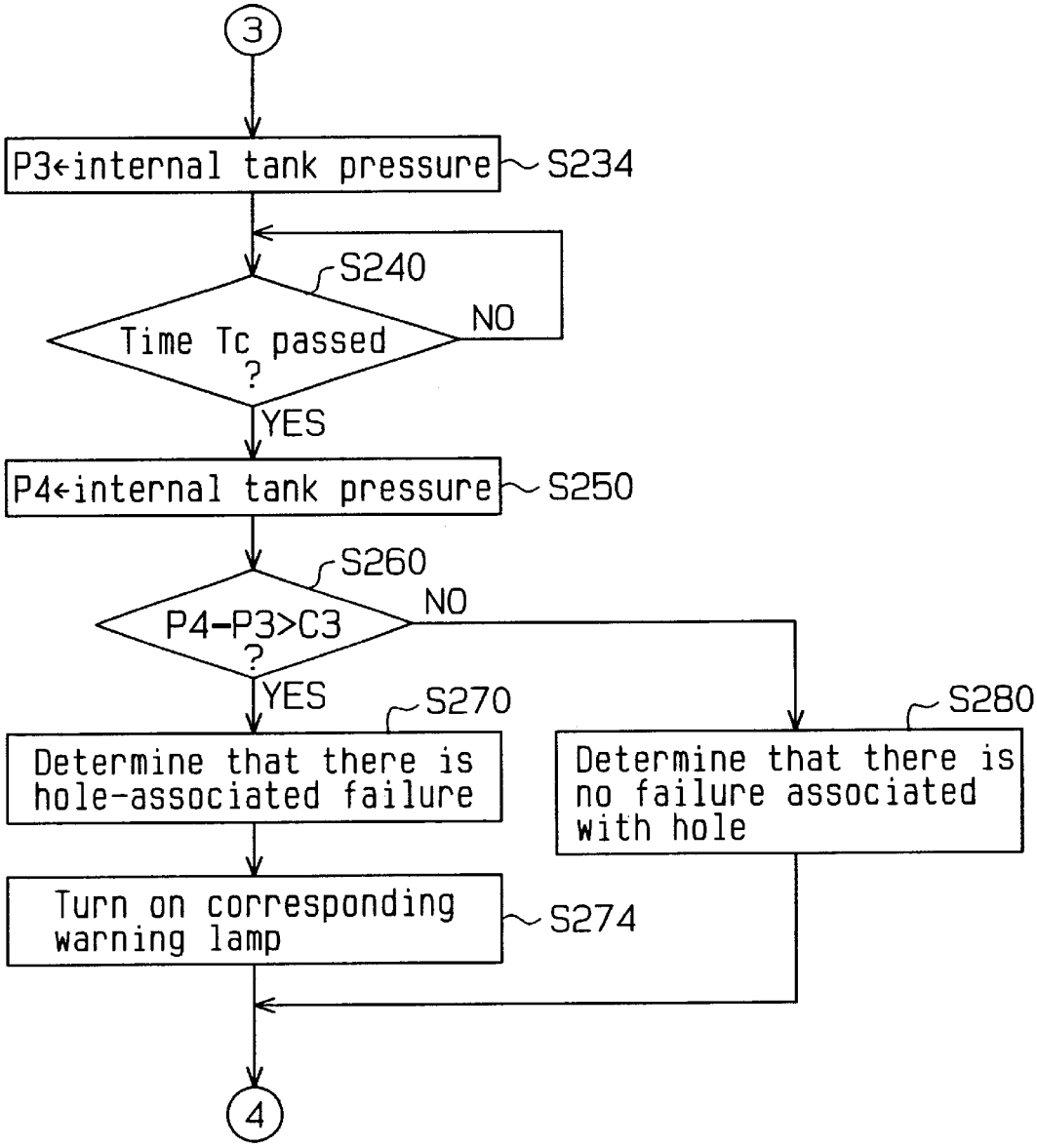
FIG. 4 is a flowchart illustrating part of the failure test routine.

Next, as shown in FIG. 4, the internal tank pressure stored as a variable P3 in the RAM area of the ECU 10 (S234). It is then determined whether a time Tc has passed since the execution of the process in step S234 (S240). When the time Tc has not yet passed (NO in S240), step S240 is repeated.

When the time Tc has passed (YES in S240; time t4), the internal tank pressure is stored as a variable P4 in the RAM area in the ECU 10 (S250). Then, it is determined whether the change (P4−P3) in the internal tank pressure at time Tc is greater than a decision value C3 (S260). This decision value C3 is a reference for determining whether the rise of the internal tank pressure is caused only by the vapor pressure over the relatively long time Tc with the fuel-vapor purging system completely sealed. The decision value C3 is chosen such that, if there is a relatively tiny hole in the fuel-vapor purging system that could not found by the testing processes in steps S120–S150, the pressure change exceeds the decision value C3.

If there is a tiny hole, the rate of increase of the internal tank pressure increases and P4–P3 becomes greater than C3 (YES in S260). Therefore, it is determined that there is a hole (S270). Specifically, a hole-associated failure flag is set. Accordingly, the corresponding warning lamp on the instrument panel in the vehicle is turned on (S274).

If there is no tiny hole, P4–P3≦C3 (NO in S260). Therefore, it is determined that there is no failure associated with a hole (S280). Specifically, the ECU 10 sets a normal flag that indicates that the test for a hole-associated failure has been terminated properly.

Figure 5:
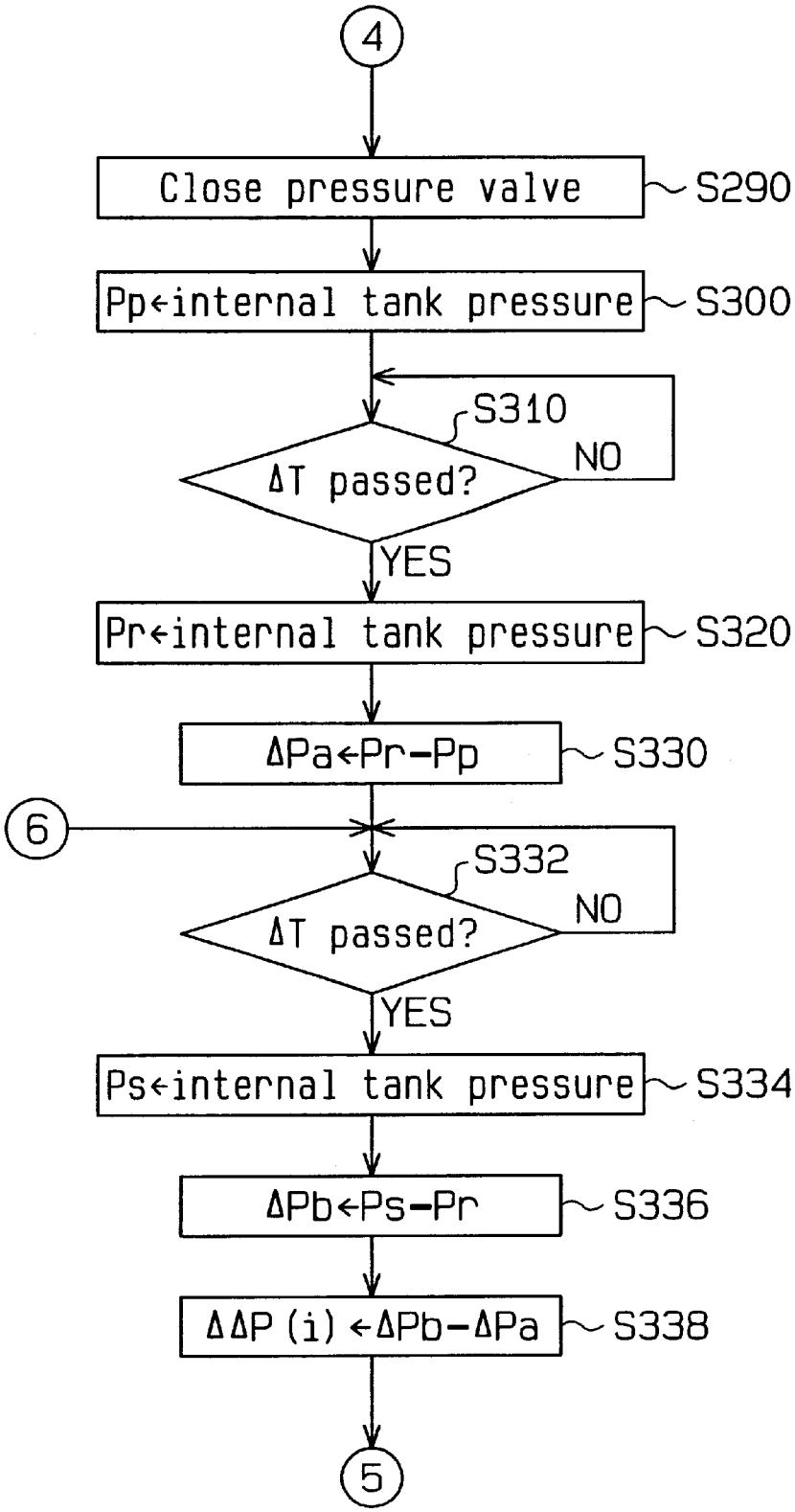
FIG. 5 is a flowchart illustrating part of the failure test routine.

After step S274 or step S280, the ECU 10 instructs that the pressure valve 27*a* be opened (S290) as shown in FIG. 5. This allows outside air to flow into the canister 2 from the intake passage 27. Then, the internal tank pressure is stored as a variable Pp in the RAM area in the ECU 10 (S300; time t5).

It is then determined whether a time ΔT has passed since the execution of the process in step S300 (S310). When the time ΔT has not yet passed (NO in S310), step S310 is repeated.

When the short time ΔT has passed (YES in S310), the internal tank pressure is stored as a variable Pr in the RAM area in the ECU 10 (S320). Next, the change ΔPa in the internal tank pressure over time ΔT is calculated using the following equation 1 and is stored in the RAM in the ECU 10 (S330).

$$\Delta Pa \leftarrow Pr - Pp \quad (1)$$

Then, it is determined whether the time ΔT has passed since the execution of the process in step S320 (S332). When the time ΔT has not passed yet (NO in S332), step S332 is repeated.

When the time ΔT has passed (YES in S332), the internal tank pressure is stored as a variable Ps in the RAM area in the ECU 10 (S334). Next, the change ΔPb in internal tank pressure at the current time ΔT is calculated from the following equation 2 and is stored in the RAM of the ECU 10 (S336).

$$\Delta Pb \leftarrow Ps - Pr \quad (2)$$

Then, a second differential value ΔΔP(i) is acquired as given by the following equation 3 and is stored in the RAM in the ECU 10 (S338).

$$\Delta\Delta P(i) \leftarrow \Delta Pb - \Delta Pa \quad (3)$$

where the value i starting from zero is incremented every time the second differential value ΔΔP(i) is acquired from the equation 3.

Figure 6:
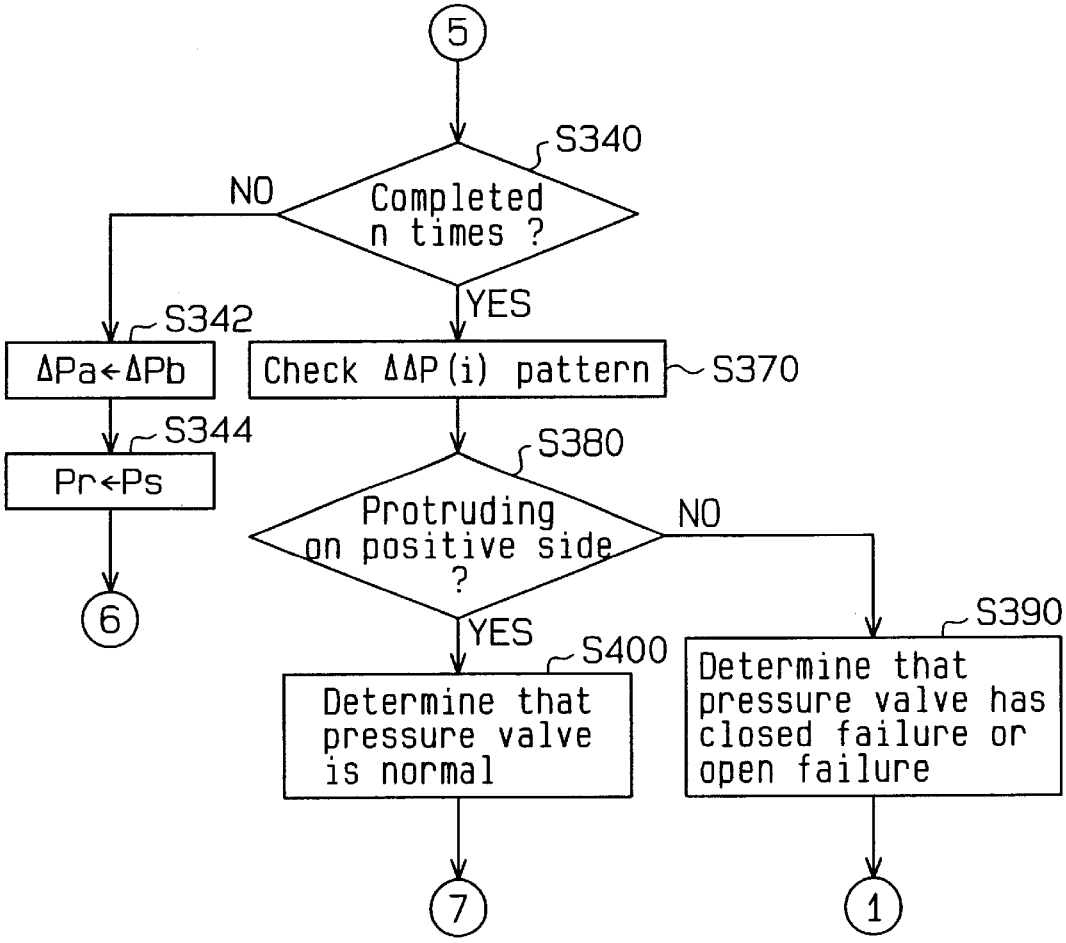
FIG. 6 is a flowchart illustrating part of the failure test routine.

Next, as shown in FIG. 6, it is determined whether the process of acquiring the second differential values ΔΔP(i) from the equation 3 has been completed n times (S340). If this process has not been completed n times (NO in S340), then the content of ΔPb is copied and stored as ΔPa (S342) and the content of ΔPs is copied and stored as ΔPr (S344). Then, the flow returns to step S332 and the ECU 10 waits for the time ΔT to pass since the inputting of the internal tank pressure in step S334 (S332).

Thereafter, the sequence of steps S332–S344 is repeated until the process in step S338 has been completed n times.

When the process in step S338 is performed n times (YES in S340), a pattern of the acquired second differential data ΔΔP(0), ΔΔP(1), . . . , ΔΔP(n−1) is checked (S370). Here, it is determined whether the pattern of the second differential data has a protruding shape on the positive side or a different one. For instance, if the second differential value gradually increases on the positive side from ΔΔP(0) to ΔΔP(x) and then decreases from ΔΔP(x) to ΔΔP(n−1), the second differential data has a protruding shape on the positive side.

Figure 10:
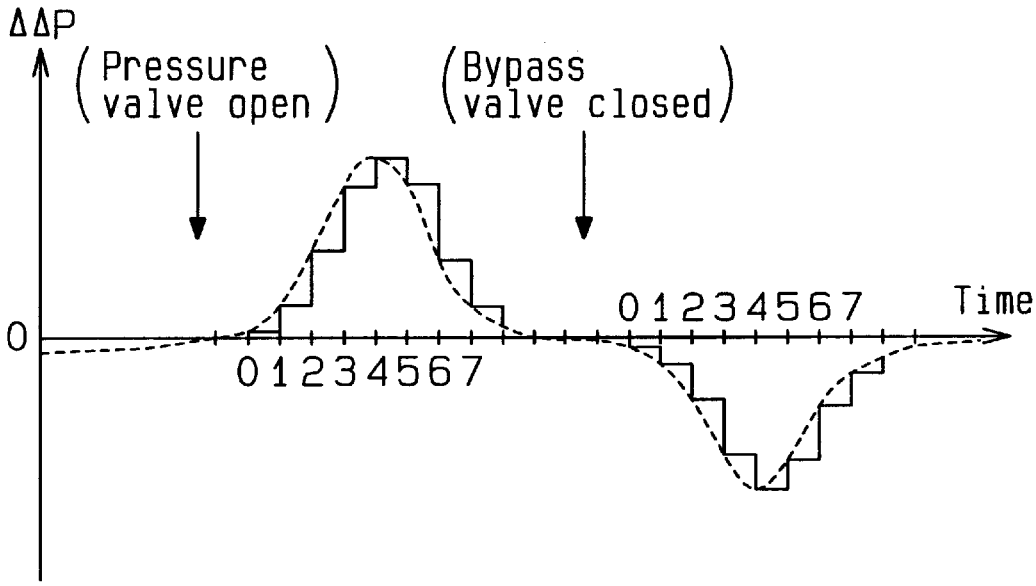
FIG. 10 is a graph representing second differential values of the internal pressure of the fuel tank over time in a differential-pressure releasing process.

If the pressure valve 27*a*, which was opened by the ECU 10 in step S290, is open properly, atmospheric pressure is applied to the fuel tank 1 via the intake passage 27, the suction control valve 13, the canister 2, the bypass passage 50 and the passage 3. This increases the rate of the rise in the internal tank pressure, which has been relatively slow due to the pressure of the fuel vapor acting alone (at and after time t5 in FIG. 9). As shown in the first half of the timing chart in FIG. 10, the pattern indicated by ΔΔP(0), ΔΔP(1), . . . , ΔΔP(7) clearly has a protruding shape on the positive side.

If the pressure valve 27*a* fails and does not open after the valve-opening instruction by the ECU 10 in step S290, the rate of increase of the internal tank pressure does not increase abruptly after time t5 in FIG. 9 as indicated by the broken line. As a result, a clear, positive protrusion as indicated by the first half of FIG. 10 does not appear.

It is therefore determined in the pattern examination in step S370 whether or not the pattern has a protruding shape on the positive side (S380). If there is no positive protruding shape (NO in S380), i.e., the change in internal tank pressure lies outside the normal acceleration range, it is determined that the pressure valve 27*a* is failing (S390). Thus, the failure flag for the pressure valve 27*a* is set.

When the result of the decision in step S380 is NO, the pressure valve 27*a* may be held open and failing (open failure) or held closed and failing (closed failure). This is because an open failure of the pressure valve 27*a* that was not detected in step S150 may be detected in step S380.

Accordingly, the corresponding warning lamp on the instrument panel in the vehicle is lit (S540), the retreat process is carried out (S550) and the failure test routine is terminated.

When there is a positive protruding shape (YES in S380), the ECU 10 determines that the pressure valve 27*a* is not failing and is normal (S400). Specifically, the ECU 10 sets a normal flag that indicates that the test for the pressure valve 27*a* has been terminated properly.

Figure 7:
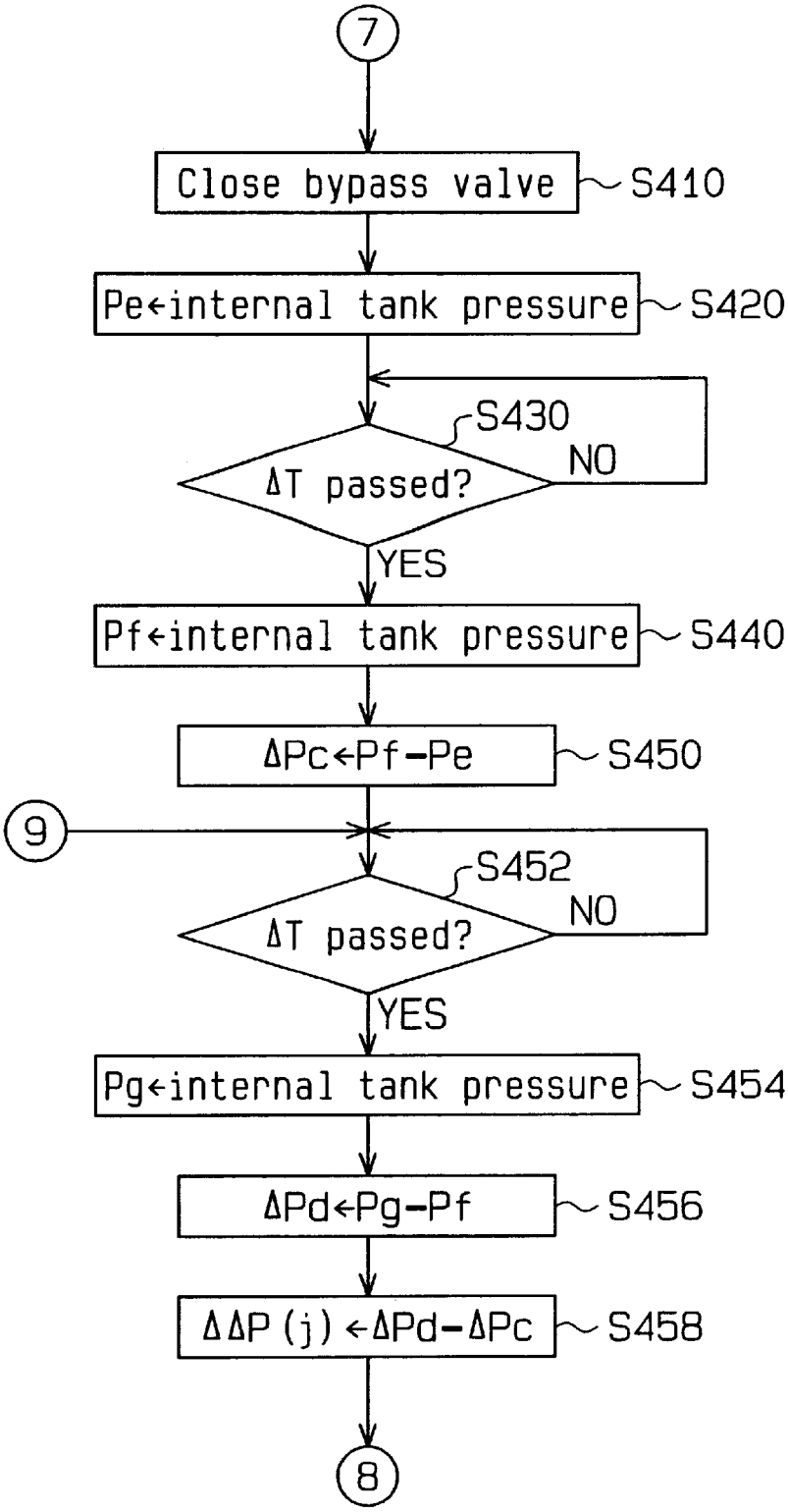
FIG. 7 is a flowchart illustrating part of the failure test routine.

As shown in FIG. 7, the ECU 10 instructs that the bypass valve 52 (S410) be closed. This closes the bypass passage 50, which stops the application of atmospheric pressure to the fuel tank 1 via the intake passage 27, the suction control valve 13, canister 2, the bypass passage 50 and the passage 3. Then, a sequence similar to the above-described steps S300 to S400 is performed.

That is, after the instruction to close the bypass valve 52 in step S410, the current internal tank pressure is stored as a variable Pe in the RAM area in the ECU 10 (S420; time t6). It is then determined whether the time ΔT has passed since the execution of step S420 (S430). When the time ΔT has not yet passed (NO in S430), step S430 is repeated.

When the time ΔT has passed (YES in S430), the current internal tank pressure is stored as a variable Pf the RAM area in the ECU 10 (S440). Next, the change ΔPc in internal tank pressure over time ΔT is calculated by the following equation 4 and is stored in the RAM in the ECU 10 (S450).

$$\Delta Pc \leftarrow Pf - Pe \quad (4)$$

Then, it is determined whether the time ΔT has passed since the execution of the process in step S440 (S452). When the time ΔT has not yet passed (NO in S452), step S452 is repeated.

When the time ΔT has passed (YES in S452), the internal tank pressure is stored as a variable Pg in the RAM area in the ECU 10 (S454). Next, the change ΔPd in internal tank pressure at the current time ΔT is calculated by the following equation 5 and is stored in the RAM in the ECU 10 (S456).

$$\Delta Pd \leftarrow Pg - Pf \quad (5)$$

Then, a second differential value ΔΔP(j) is acquired as given by the following equation 6 and is stored in the RAM in the ECU 10 (S458).

$$\Delta\Delta P(j) \leftarrow \Delta Pd - \Delta Pc \quad (6)$$

where the value j starting from zero is incremented every time the second differential value ΔΔP(j) is acquired from the equation 6.

Next, as shown in FIG. 8, it is determined whether the process of acquiring the second differential values ΔΔP(j) by the equation 6 has been performed m times (S460). If this process has not been completed m times (NO in S460), then the content of ΔPd is copied and stored as ΔPc (S462) and the content of ΔPg is copied and stores as ΔPf (S464). Then, the flow returns to step S452 and the ECU 10 waits for the time ΔT to pass from when step S454 (S452) was performed.

Thereafter, the sequence of steps S452–S464 is repeated until the process in step S458 is completed m times.

When the process in step S458 has been performed m times (YES in S460), the pattern of the acquired second differential data ΔΔP(0), ΔΔP(1), . . . , ΔΔP(m−1) is checked (S490). Here, it is determined whether the pattern of the second differential data has a negatively protruding shape. For instance, if the second differential value gradually decreases on the negative side from ΔP(0) to ΔΔP(y) and then increases from ΔΔP(y) to ΔΔP(m−1), the second differential data has a negatively protruding shape.

If the bypass valve 52, the closure of which is instructed by the ECU 10 in step S410, is closed properly, the atmospheric pressure is not supplied to the fuel tank 1 via the bypass passage 50 and the passage 3. This slows down the rate of increase in the internal tank pressure, which is relatively fast when the atmospheric pressure is applied (at and after time t6 in FIG. 9). As shown in the second half of the timing chart in FIG. 10, the pattern indicated by ΔΔP(0), ΔΔP(1), . . . , ΔΔP(7) clearly has a negatively protruding shape.

If the bypass valve 52 fails and is not closed when instructed by the ECU 10 in step S410, the rate of increase of the internal tank pressure does not drop abruptly after time t6 in FIG. 9 as indicated by the broken chain line. As a result, a clear, negatively protruding shape like that of the second half of FIG. 10 does not appear.

It is therefore determined in the pattern examination in step S490 whether or not the pattern has a recessed shape on the negative side (S500). If there is no negatively protruding shape (NO in S500), i.e., if the change in internal tank pressure lies outside the normal deceleration range, it is determined that the bypass valve 52 is failing (S530). Thus, the failure flag for the bypass valve 52 is set.

When the result of the decision in step S500 is NO, the failure of the bypass valve 52 may be a closed failure, where the valve 52 is held closed, or an open failure, where the valve 52 is held open. This is because a closed failure of the bypass valve 52 that was not been detected in step S150 may be detected in step S500.

Accordingly, the corresponding warning lamp on the instrument panel in the vehicle is lit (S540), the retreat process is carried out (S550) and the failure test routine is then terminated.

When there is a negatively protruding shape (YES in S500), the ECU 10 determines that the bypass valve 52 is not failing and is normal (S510). Thus, the ECU 10 sets a normal flag, which indicates that the test for the bypass valve 52 has been terminated properly. When the flow reaches step S510, the purge control valve 11 is opened to enable purging to the surge tank 9*a* from the purge passage 8 (S520; time t7).

In the first embodiment, steps S110 and S130 are a differential-pressure forming process, step S170 is a sealing process and steps S290 and S410 are a differential-pressure releasing process. Those steps together with steps S234, S240, S250, S260, S270 and S280 are performed by a leak-associated failure test means.

Steps S120, S140, S150, S160, S180, S190, S200, S210, S220, S300–S400, S420–S510 and S530 are performed by a failure test means and a failure detection means. The steps in the individual processes are a process of the valve control means, and steps S234, S240, S250, S260, S270 and S280 are a process of the leak-associated failure detection means.

The above-described first embodiment has the following advantages.

(1) The failure test routine of the first embodiment executes processes similar to those when leak-associated failure is performed alone. They are the differential-pressure forming process (S110, S130) of providing a differential pressure between the inside and outside of the fuel-vapor purging system, the sealing process (S170) of sealing the fuel-vapor purging system, and the differential-pressure releasing process (S290, S410) of releasing the differential pressure after leakage inspection.

The valve failure testing of the three valves 11, 27*a* and 52 is carried out to check for a failure in any valve to be actuated in any of the above-described three processes for leak-associated failure testing by measuring the internal tank pressure and checking the behavior of this internal pressure using the three processes.

Therefore, using the process for starting leak testing or the process for terminating the leak testing allows the valve failure test to be carried out within the time needed for leak testing and without substantially overlapping the leak test. It is thus possible to separately and accurately perform the individual tests based on a change in the internal tank pressure and to complete two kinds of failure tests, leak-associated failure testing and valve failure testing, within the time needed for a single test.

Even when two kinds of failure tests are performed, the application of negative pressure to the fuel-vapor purging system through the intake system, disabling purging and enabling purging, are carried out only once, so that the time required for the two failure tests hardly differs from the time required for a single failure tests. This minimizes the influence of the tests on the air-fuel ratio in the intake system of the engine. Therefore, even when two kinds of failure tests are performed the amount of emissions does not increase.

(2) With regard to the differential-pressure forming process (S110, S130), a drop in the internal tank pressure is checked. This makes it possible to detect whether at least one of the three valves 11, 27*a* and 52, if any, is failing and to detect whether there is a large hole in the fuel-vapor purging system itself.

(3) With regard to the differential-pressure releasing process (S290, S410), the pattern of the second differential values of the internal tank pressure is checked (S300–S400, S420–S510, S530). Detecting a change in the rate of change of the internal tank pressure by checking the pattern of the second differential values ensures a very accurate failure test of the pressure valve 27*a* and the bypass valve 52.

Second Embodiment

The second embodiment will now be discussed, concentrating on the differences from the first embodiment.

According to the first embodiment, as described above, when the purge control valve 11 and the pressure valve 27*a* can be closed and the bypass valve 52 can be opened (times t2–t5 in FIG. 5), only the pressure valve 27*a* is opened (time t5), after which a failure in the pressure valve 27*a* is determined based on a change in the internal tank pressure. Then, the bypass valve 52 is closed (time t6) after which a failure in the bypass valve 52 is likewise determined based on a change in the internal tank pressure.

When the pressure valve 27*a* is opened as mentioned above, air enters the canister 2 through the intake passage 27, which causes the internal pressure of the canister 2 to rise abruptly. Since the fuel tank 1 is connected to the canister 2 by the bypass passage 50, the internal tank pressure rises too. At this time, the rise of the internal tank pressure lags behind the rise of the internal pressure of the canister 2. Accordingly, the internal tank pressure is temporarily lower than the internal pressure of the canister 2. The shorter the time lapse from the opening of the pressure valve 27*a* is, the greater the difference between their internal pressures is. For a predetermined period of time after the opening of the pressure valve 27*a*, therefore, the differential pressure between the fuel tank 1 and the canister 2 may become equal to or higher than a predetermined level, which opens the vapor relief valve 23 open so that back purging is carried out.

If a failure test of the bypass valve 52 is performed when the valve 52 is closed while back purging is being carried out, the internal tank pressure varies due to the influence of the internal pressure of the canister 2. This is likely to lead to lower accuracy in the failure test.

This embodiment is designed to further improve the accuracy of the failure test of the bypass valve 52 by avoiding the adverse influence of back purging during testing of the bypass valve 52.

The following are details of the failure test routine according to this embodiment.

Figure 11:
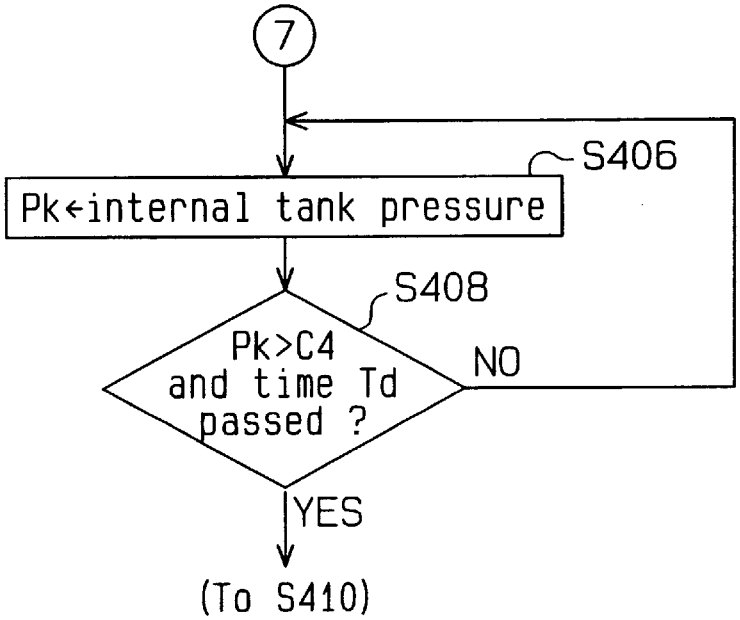
FIG. 11 is a flowchart illustrating part of a failure test routine according to a second embodiment.

In this embodiment, the failure test routine illustrated in FIGS. 2 to 8 is executed with part of the routine modified. FIG. 11 is a flowchart illustrating the modified procedures. The sequence of FIG. 11 is executed after step S400 of FIG. 6 and before step S410 of FIG. 7.

When the ECU 10 determines that the pressure valve 27*a* is not failing and is normal (S400 in FIG. 6), the internal tank pressure is stored as a variable Pk in the RAM area in the ECU 10 (S406). It is then determined whether the pressure value Pk is greater than a predetermined decision value C4 and whether a predetermined time Td has passed since the execution of the instruction to open the pressure valve 27*a* in step S290 (S408).

This decision value C4 and the predetermined time Td are both for determining whether back purging is being performed. The longer the time lapse from when the pressure valve 27*a* is opened, the smaller the delay in the response of the internal tank pressure to a change in the internal pressure of the canister 2 becomes. For a given elapsed time, as the internal tank pressure increases, which reduces the difference from the atmospheric pressure, the differential pressure decreases. By setting the decision value C4 and the predetermined time Td based on the above relationship and comparing the internal tank pressure with the time elapsed since the opening of the pressure valve 27*a*, it is possible to reliably determine whether the differential pressure is lower than that present when the vapor relief valve 23 is opened. Therefore, the ECU 10 can determine whether back purging is being performed.

When the decision conditions in this step S408 are not met, the internal tank pressure is measured again (S406) and the determination of whether back purging (S408) is occurring is repeated. Therefore, the bypass valve 52 is not closed until back purging is not being carried out. This delays the execution of the failure test on the bypass valve 52.

When it is determined that the internal tank pressure (pressure value Pk) is greater than the decision value C4 and the predetermined time Td has passed since the opening of the pressure valve 27*a* (YES in S408), the bypass valve 52 is closed (S410 in FIG. 7). A failure in the bypass valve 52 is then tested in the subsequent process.

The above-described second embodiment has the following advantages in addition to the three advantages (1) to (3) of the first embodiment.

(4) In the failure test routine of this embodiment, in executing a failure test on the bypass valve 52 after the failure test on the pressure valve 27*a* is carried out, the time for starting the failure testing is delayed until the differential pressure between the fuel tank 1 and the the canister 2 decreases to a level low enough such that it is certain that back purging is not being executed. This prevents the internal tank pressure from being changed by back purging and allows a change in the internal tank pressure to be associated only with the closing of the bypass valve 52. It is therefore possible to avoid the adverse influence of back purging and to improve the accuracy of the failure test of the bypass valve 52.

(5) When back purging is not being performed is determined not only by the time elapsed from when the pressure valve 27*a* is closed but also by the internal tank pressure. The decision can therefore be made with higher accuracy. It is therefore possible to avoid the adverse influence of back purging, to further improve the accuracy of the failure test of the bypass valve 52.

Third Embodiment

The third embodiment of this invention will now be discussed, concentrating on the differences from the first embodiment.

In the first embodiment, the failure test routine is executed when predetermined conditions (the execution conditions for the failure test routine) are satisfied. The conditions include, for example, the following conditions in addition to the aforementioned conditions that nothing is wrong with the pressure sensor 1*a* and other sensors.

(a) The surface of the fuel in the fuel tank 1 is relatively calm.

(b) The amount of fuel vapor generated in the fuel tank 1 is relatively small.

(c) The amount of fuel remaining in the fuel tank 1 does not exceed a predetermined amount (or does not exceed the maximum capacity of the tank).

The conditions (a) to (c) help to ensure that a variation in the internal tank pressure is in a tolerable range that will not adversely affect the failure test. Whether or not those conditions (a) to (c) are satisfied is determined based on a change in internal tank pressure.

When the fuel surface in the fuel tank moves dramatically, as when the vehicle is running on a rough road, for example, the internal tank pressure changes significantly according to the movement. This motion prevents accurate failure testing.

When a lot of fuel vapor is generated in the fuel tank 1, the internal tank pressure increases considerably. When the fuel tank 1 is filled with the maximum amount of fuel, the volume of the space in the fuel tank 1 above the fuel becomes smaller, and slight motion of the fuel surface causes a significant change in the internal tank pressure. In those cases, an accurate failure test is not possible either.

When the conditions (a) to (c) are met, however, the failure test is accurate.

Including those conditions (a) to (c) in the execution conditions for the failure testing raises the following problem when the bypass valve 52 is held open.

When the bypass valve 52 is held open, the canister 2 always communicates with the fuel tank 1 via the bypass passage 50 and the passage 3. As a result, the internal pressure of the canister 2 varies in accordance with the purge flow rate and so does the internal tank pressure. The conditions (a) to (c) are determined on the basis of a change in internal tank pressure. If the internal tank pressure changes according to the purge flow rate, the conditions (a) to (c) are not satisfied even if there is very little change in the internal tank pressure due to movement of the fuel surface, generation of fuel vapor in the fuel tank 1, or the like. When the bypass valve 52 is held open, therefore, the failure test routine will not be carried out.

According to this embodiment, if it is predicted that the bypass valve 52 is open, the conditions (a) to (c) are excluded from the execution conditions for the failure test routine and the failure test routine for the bypass valve 52 is carried out regardless of the conditions (a) to (c).

Referring now to FIGS. 12 through 16, a procedure for predicting whether the bypass valve 52 is being held open and a procedure for determining the execution conditions for the failure test routine based on the prediction result will flow.

Figure 12:
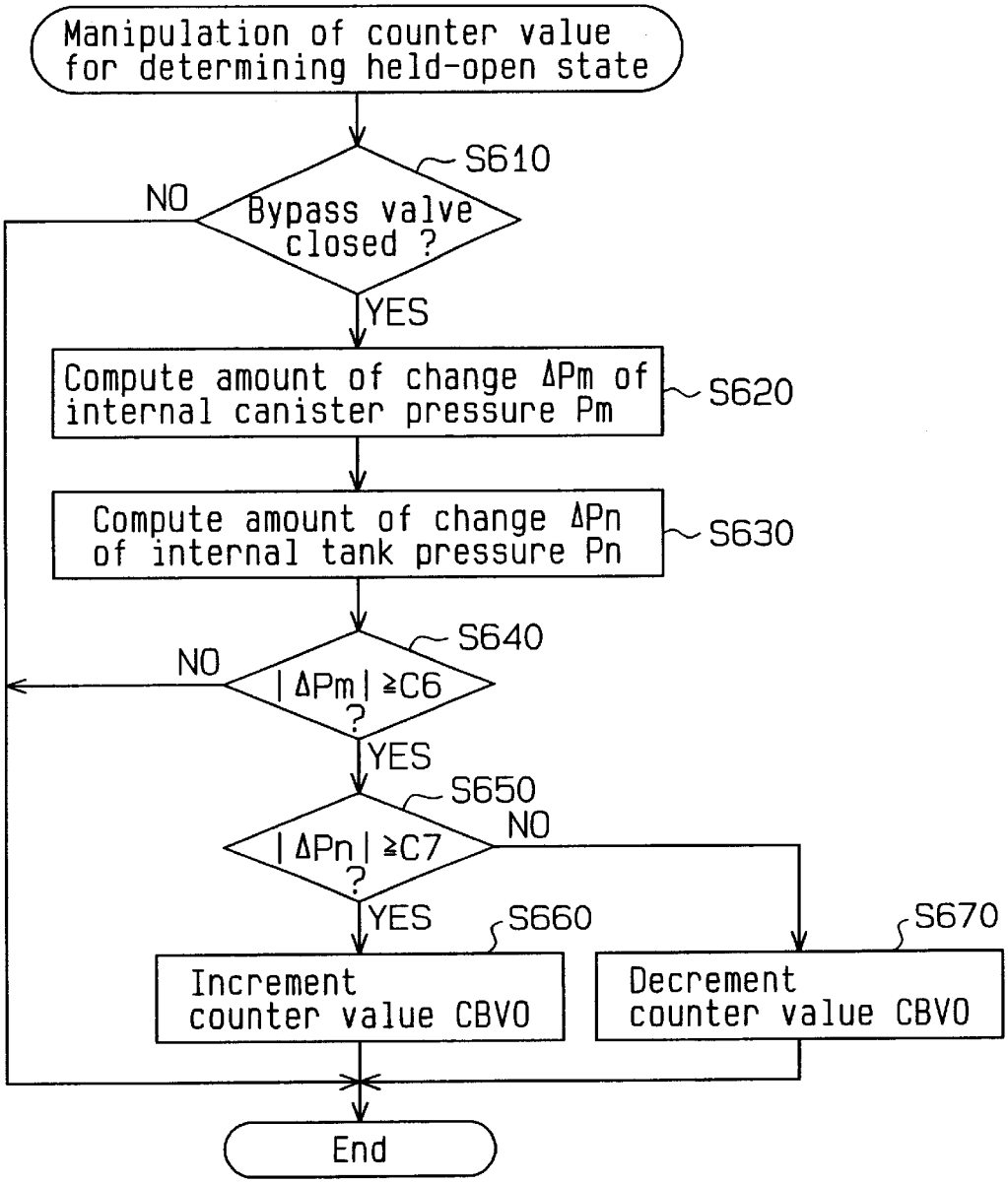
FIG. 12 is a flowchart showing manipulation of a counter value for determining the state of a valve being held open according to a third embodiment.
Figure 13:
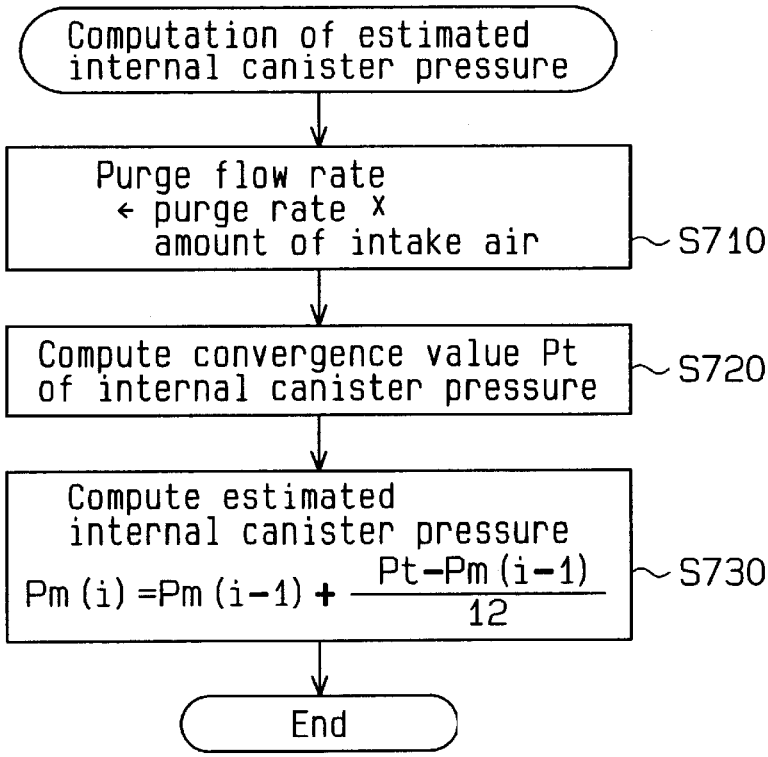
FIG. 13 is a flowchart showing routine for calculating an estimated canister internal pressure according to the third embodiment.

FIGS. 12 and 13 are flowcharts showing a procedure for judging the state of the bypass valve 52.

In the illustrated routines, when the bypass valve 52 is closed, the internal pressure of the canister 2 is estimated based on the purge flow rate, and the state of the bypass valve 52 is judged by determining whether the estimated value has a given correlation with the actual internal pressure of the fuel tank 1.

In the routine shown in FIG. 12, it is determined first whether the bypass valve 52 is closed (S610). If the bypass valve 52 is not closed (NO in S610), the routine is temporarily terminated.

When the bypass valve 52 is closed (YES in S610), the amount of a change, ΔPm, in the estimated internal pressure of the canister 2 Pm over a predetermined time Te (e.g., 5 sec) is calculated (S620). The estimated canister pressure Pm is estimated based on the purge flow rate and is acquired by, for example, the procedure illustrated in FIG. 13.

First, the purge rate is multiplied by the amount of intake air detected by the air flow meter 9*c*, and the product (purge rate x amount of intake air) is designated as the purge flow rate (S710 in FIG. 13). The purge rate is the ratio of the amount of fuel vapor supplied to the combustion chamber of the engine from the fuel-vapor purging system to the amount of intake air supplied to this combustion chamber (fuel vapor amount/intake air amount). The ECU 10 sets the purge rate in accordance with the running conditions of the engine and stores it in the RAM. The position (angle) of the purge control valve 11 is determined by to the purge rate.

Figure 14:
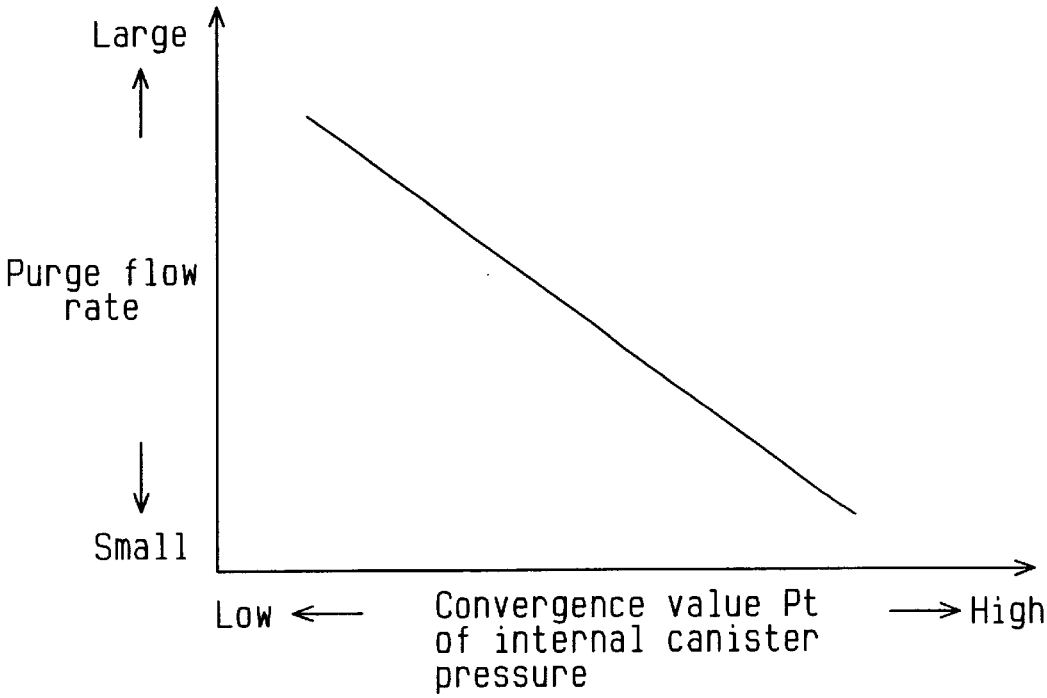
FIG. 14 is an operation map showing the relationship between a purge flow rate and a convergence value of the internal pressure of the canister.

Next, a convergence value Pt of the internal pressure of the canister 2 is computed based on the purge flow rate (S720). The convergence value Pt is the value to which the internal pressure of the canister 2 converges when the purge flow rate constant. The relationship between the purge flow rate and the convergence value Pt of the internal canister pressure has previously been acquired through experiments or the like and has been stored in the memory (ROM) in the ECU 10 as an operation map as shown in FIG. 14.

Then, the computed convergence value Pt of the internal canister pressure is subjected to grading based on the following equation 7, which yields the estimated internal canister pressure Pm. The grading process permits the routine to take into account the response delay that occurs when the internal canister pressure varies according to a change in the purge flow rate and makes the estimated internal canister pressure Pm follow the actual change in the internal canister pressure.

$$Pm(i) \leftarrow Pm(i-1)+(Pt-Pm(i-1))/12 \quad (7)$$

where Pm(i−1) is the previous value of the estimated internal canister pressure Pm.

In step S630 in FIG. 12, the amount of a change, ΔPn, in the actual internal tank pressure Pn over the predetermined time Te is computed. It is then determined whether the absolute value |ΔPm| of the change ΔPm of the estimated internal canister pressure Pm is equal to or greater than a predetermined decision value C6 (e.g., 5 mHg) (S640). That is, it is determined in this step whether the internal canister pressure greatly varies in accordance with a change in the purge flow rate. When the absolute value |ΔPm| is less than the decision value C6 (NO in S640), the routine is temporarily terminated.

When the absolute value |ΔPm| is equal to or greater than the decision value C6 (YES in S640), on the other hand, it is then determined whether the absolute value |ΔPn| of the change ΔPn of the internal tank pressure Pn is equal to or greater than a predetermined decision value C7 (e.g., 3 mHg) (S650). When the absolute value |ΔPn| is equal to or greater than the decision value C7 (YES in S650), a counter value CBVO for determining the state of the bypass valve 52 is incremented (S660). When the absolute value |ΔPn| is less than the decision value C7 (NO in S650), however, the counter value CBVO is decremented (S670). After the counter value CBVO is manipulated in the step S660 or S670, the routine is temporarily terminated.

The counter value CBVO is incremented when it is determined that the internal tank pressure Pn is likely to change according to a change in the estimated internal canister pressure Pm (YES in S650) but is decremented when it is likely that the internal tank pressure Pn will not change even if the estimated internal canister pressure Pm changes (NO in S650).

When the counter value CBVO is equal to or larger than a predetermined decision value, therefore, it is estimated that the bypass valve 52 is being held open because there is a correlation between the change of the internal canister pressure and the change of the internal tank pressure, even though the bypass valve 52 is closed, which disconnects the canister 2 from the fuel tank 1.

Figure 15:
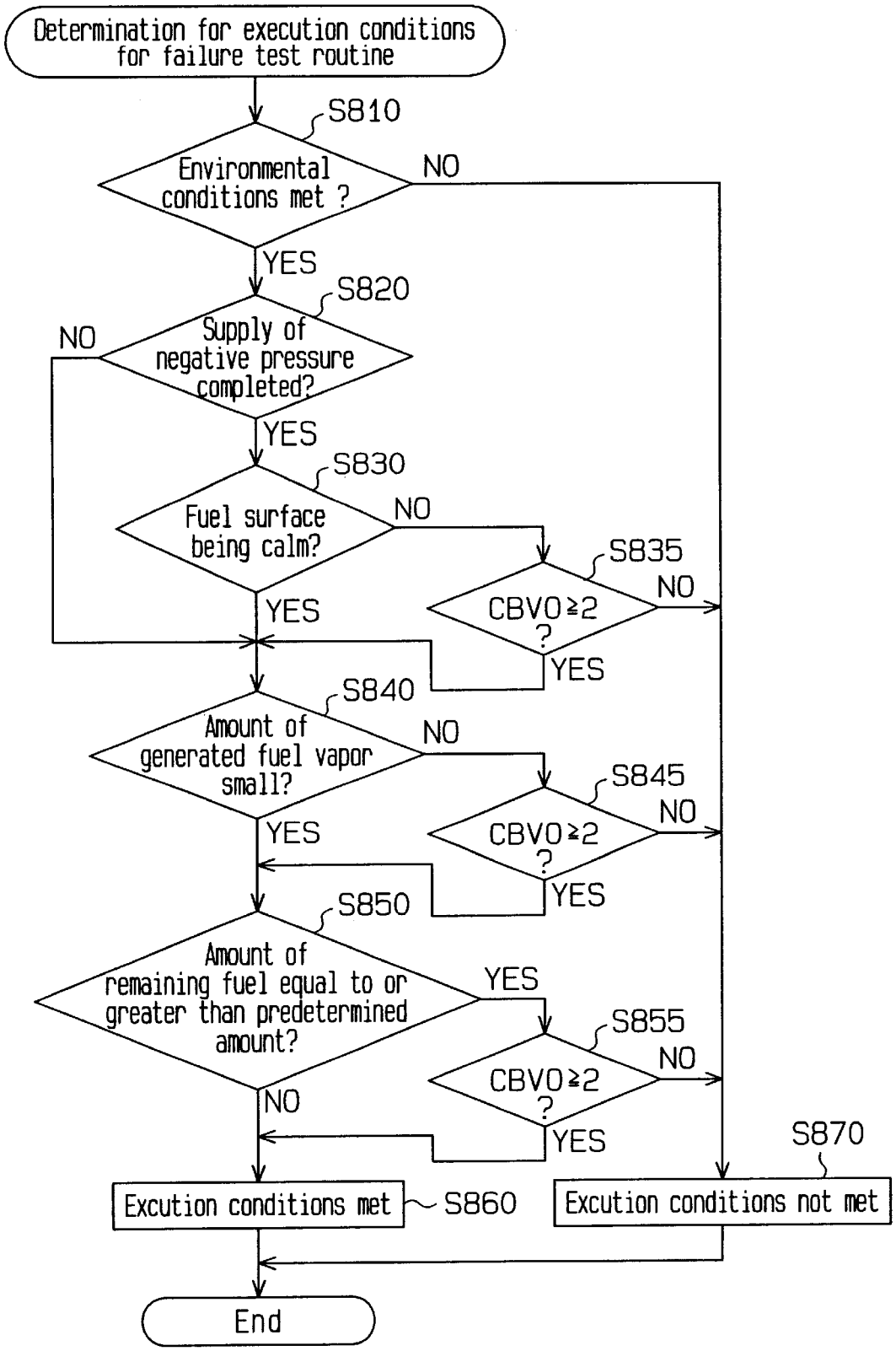
FIG. 15 is a flowchart illustrating a determination of whether conditions are met for execution of a failure test routine according to the third embodiment.

The procedure for determining the execution conditions for the failure test routine will now be described with reference to the flowchart shown in FIG. 15. The sequence illustrated in FIG. 15 is repeated even after the failure test routine is started. Even when the execution conditions for the failure test routine are temporarily satisfied and the test routine is initiated, therefore, the test routine will be terminated if the execution conditions are subsequently not met.

In determining the execution conditions for the failure test routine, first, it is determined whether the environmental conditions are met (S810). The environmental conditions include, for example, that nothing is wrong with the pressure sensor 1*a* and other sensors, the vehicle is not running at high elevation (which is predicted based on the running conditions of the engine), the battery voltage is equal to or higher than a predetermined voltage, and the coolant temperature at the time the engine is started falls within a predetermined temperature range.

When the environmental conditions are all satisfied (YES in S810), it is determined whether feeding a negative pressure has been applied to the fuel-vapor purging system (S820). When the negative pressure has been applied (YES in S820), it is then determined whether the fuel surface is in the fuel tank 1 is currently disturbed (S830).

Specifically, the last decision is made by acquiring a second differential value over a predetermined time (e.g., 65 msec), calculating the absolute value of the second differential value and then comparing the calculated absolute value with a predetermined decision value. That is, when the calculated absolute value is equal to or greater than the predetermined decision value, it is determined that the fuel surface in the fuel tank 1 is disturbed (moving dramatically).

The decision regarding the disturbance of the fuel surface is not carried out when the failure test routine has not been initiated or the negative pressure has not been applied to the fuel-vapor purging system (NO in S820). In other words, the fuel disturbance determination process (S830) is performed only when the negative pressure is applied to the fuel-vapor purging system, and a test for the presence or absence of a hole or the like will take place subsequently.

When it is determined that the fuel surface is not disturbed (YES in S830) or that negative pressure has not been applied to the fuel-vapor purging system (NO in S820), the flow proceeds to step S840 to determine whether there is a small amount of fuel vapor being generated in the fuel tank 1.

In this step, the amount of change in the internal tank pressure over a predetermined time interval (e.g., 15 sec) is acquired multiple times (e.g., three times), and it is determined that the amount of fuel vapor generated in the fuel tank 1 is small when the amount of change each time is smaller than a predetermined decision value.

When it is determined that the amount of fuel vapor generated in the fuel tank 1 is small (YES in S840), it is then determined whether the amount of fuel remaining in the fuel tank 1 is equal to or greater than a predetermined amount, i.e., if the fuel tank 1 is filled with the maximum amount of fuel (S850).

In this step, the detected value of the internal tank pressure is integrated for a predetermined period (e.g., 520 msec) after every predetermined time interval (e.g., 65 msec), a differential value of the integrated value is acquired. It is determined that the amount of fuel remaining in the fuel tank 1 is equal to or greater than the predetermined amount when a change in this differential value is larger than a predetermined decision value.

When it is determined that the amount of fuel remaining in the fuel tank 1 is not equal to or greater than the predetermined amount (NO in S850), i.e., when all of the environmental conditions and the aforementioned conditions (a) to (c) are satisfied, the execution conditions for the failure test routine are met, and a flag that so indicates is set ON (S860).

When it is determined that the fuel surface is not disturbed (NO in S830), that a large amount of fuel vapor is being generated in the fuel tank 1 (NO in S840) or that the amount of fuel remaining in the fuel tank 1 is equal to or greater than the predetermined amount (YES in S850), it is determined whether the counter value CBVO for determining the held-open state is two or greater (S835, S845 or S855). When the counter value CBVO is less than two, from which it is judged that the bypass valve 52 is not being held open (NO in S835, S845 or S855), the execution conditions for the failure test routine are not satisfied, and the flag indicating the satisfaction of those conditions is set OFF (S870). When the environmental conditions are not satisfied (NO in S810), the flag indicating the satisfaction of those conditions is likewise set OFF (S870).

When the counter value CBVO is equal to or greater than two and it is predicted that the bypass valve 52 is being held open (YES in S835, S845 or S855), the execution conditions for the failure test routine are satisfied regardless of the decision result of the associated step S830, S840 or S850, and the flag indicating the satisfaction of those conditions is set ON (S860). After the flag indicating that the execution conditions for the failure test routine are met is set ON or OFF, the routine is temporarily terminated.

According to this embodiment, when it is predicted that the bypass valve 52 is being held open, the failure test routine is carried out even if all of the conditions (a) to (c) are not satisfied.

When the bypass valve 52 is held open, thereby causing the failure test routine to be executed, it is normally determined that the bypass valve 52 is failing (NO in S500 in FIG. 8). If the rate of increase of the internal tank pressure falls due to an increase in the purge flow rate when the bypass valve 52 is closed, it may be erroneously determined that the bypass valve 52 is normal although the valve 52 is actually being held open.

According to this embodiment, part of the failure test routine illustrated in FIGS. 2 to 8 is modified such that, when it is judged that the bypass valve 52 is held open, a determination of whether the valve 52 is normal will be postponed.

Figure 16:
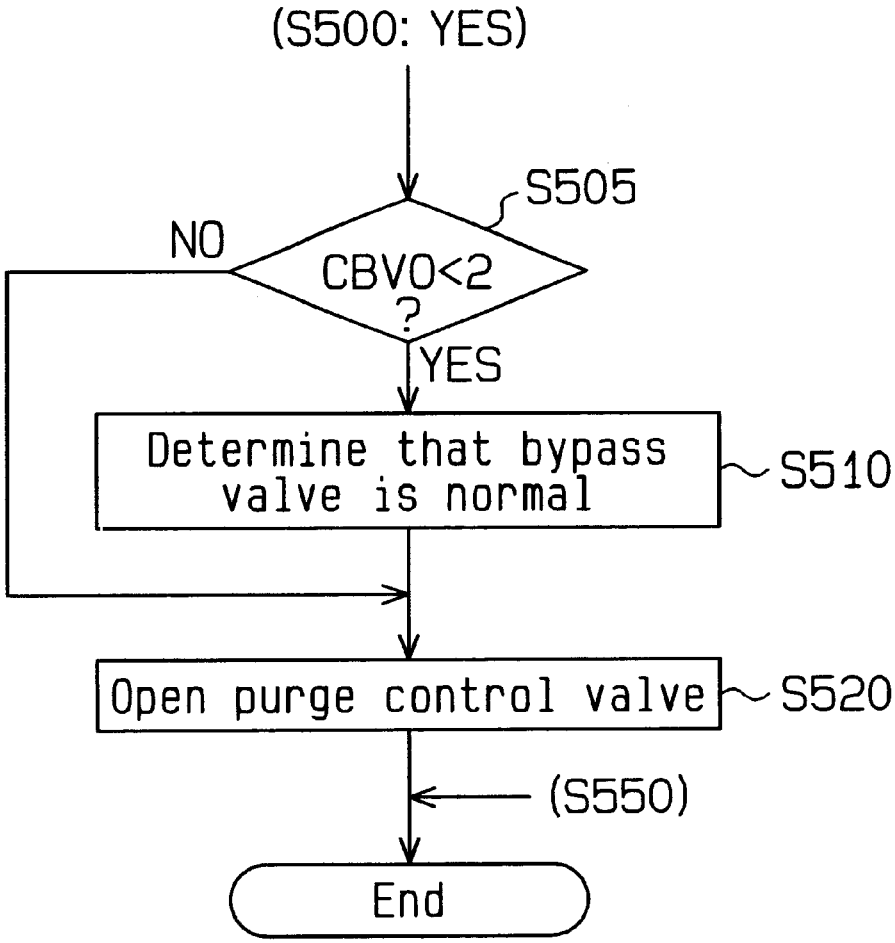
FIG. 16 is a flowchart illustrating part of the failure test routine according to the third embodiment.

FIG. 16 is a flowchart illustrating the modified procedure. As shown in FIG. 16, when it is determined in step S500 in FIG. 8 that a change in the internal tank pressure lies within the normal deceleration range (YES in S500), it is then determined whether the counter value CBVO for determining the held-open state is less than two. When the counter value CBVO is less than two and it is judged that the bypass valve 52 is not being held open, it is determined that the valve 52 is normal (S510).

When the counter value CBVO is equal to or larger than two and it is judged that the bypass valve 52 is being held open, the determination that the valve 52 is normal is not made and the aforementioned process of step S520 is performed instead. This avoids an erroneous determination that the bypass valve 52 is normal even though the valve 52 is actually being held open.

The third embodiment has the following advantages in addition to the advantages (1) to (3) of the first embodiment.

(6) In the failure test routine of this embodiment, whether or not the bypass valve 52 is held open is judged based on the presence or absence of correlation between the internal canister pressure and the internal tank pressure. When it is judged that the valve 52 is being held open, the conditions (a) to (c) for determining whether a change in the internal tank pressure lies within the tolerable range are excluded from the conditions for executing the failure test routine. Even if the internal tank pressure varies according to a change in the purge flow rate because the bypass valve 52 is being held open, the failure test routine is carried out. This provides an earlier determination of a failure in the bypass valve 52.

(7) When it is judged that the bypass valve 52 is being held open, the determination of whether the valve 52 is normal is postponed. This avoids an erroneous determination that the bypass valve 52 is normal even though the valve 52 is actually being held open.

Other Embodiments

In the first embodiment, because purge control can be carried out without any problem if a hole in the fuel-vapor purging system is very small, the purge control valve 11 is opened even when a tiny hole is detected. However, when a tiny hole is detected, the flow may jump to the processes of steps S540 and S550 to disable the purge control, as is done when the other failures occur.

Although failures in the pressure valve 27*a* and the bypass valve 52 in the differential-pressure releasing process (S290, S410) are determined based on a pattern of second differential values, such failures may be detected by analyzing variation in the first differential value.

While the pressure sensor 1*a* is shown to be attached to the fuel tank 1, it can be mounted anywhere as long as it can detect the internal pressure of the fuel-vapor purging system. For instance, the pressure sensor 1*a* may be provided in the canister 2.

In the second embodiment, the predetermined time Td may vary based on the internal tank pressure that is detected when the pressure valve 27*a* is opened.

Although a plurality of conditions including the conditions (a) to (c) are set as the execution conditions for the failure test routine in the third embodiment, those conditions may be used individually or in combination.

In the individual embodiments, when testing for a failure in the pressure valve 27*a*, a time-sequential pattern of the second differential values of the internal tank pressure is examined, and it is determined that the pressure valve 27*a* is failing when this pattern does not have a positively protruding shape, which indicates that a change in internal tank pressure lies outside the normal acceleration range. Alternatively, such a determination may be made based on the maximum value of the second differential values of the internal tank pressure. Specifically, if the maximum value is equal to or smaller than a predetermined value, for example, it may be determined that a change in the internal tank pressure lies outside the normal acceleration range, indicating that the pressure valve 27*a* is failing. In determining a failure in the bypass valve 52, similarly, when the minimum value of the second differential values of the internal tank pressure is equal to or greater than a predetermined value, it may be determined that a change in the internal tank pressure lies outside the normal deceleration range, indicating that the valve 52 is failing.

Therefore, the present examples and embodiments are to be considered as illustrative and not restrictive and the invention is not to be limited to the details given herein, but may be modified within the scope and equivalence of the appended claims.

What is claimed is:

1. A failure test apparatus for a fuel-vapor purging system for adsorbing fuel vapor in a fuel tank into a canister and purging fuel in the canister to an intake system of an internal combustion engine as needed, the system having at least one valve, the apparatus comprising:

first test means for providing a differential pressure between the inside and the outside of the fuel-vapor purging system, measuring the internal pressure with the fuel-vapor purging system when in an airtight condition and determining whether a leak exists in the fuel-vapor purging system from the behavior of the internal pressure, the determination by the first test means including a differential-pressure forming process of creating a differential pressure between the inside and the outside of the fuel-vapor purging system, a sealing process for making the fuel-vapor purging system airtight when the differential pressure exists, and a differential-pressure releasing process for releasing the differential pressure; and second test means for measuring the internal pressure of the fuel-vapor purging system in association with one or more of the processes to thereby detect a failure in the valve based on the behavior of the internal pressure.

2. A failure test apparatus for a fuel-vapor purging system having a fuel tank, a canister, a passage for conducting fuel vapor from the fuel tank to the canister, an internal-pressure control valve for opening or closing the passage in accordance with the internal pressure of the fuel tank, an intake passage for supplying outside air to the canister, an intake control valve for opening or closing the intake passage in accordance with the internal pressure of the canister, a purge passage for purging fuel in the canister to an intake system of an internal combustion engine, and a purge control valve for opening or closing the purge passage in accordance with the operational state of the internal combustion engine, the apparatus comprising:

a pressure sensor for detecting the internal pressure of the fuel tank;

a bypass passage for connecting the fuel tank to the canister;

a bypass valve for opening or closing the bypass passage;

a pressure valve for opening or closing the intake passage;

valve control means for executing a differential-pressure forming process of applying a negative pressure of the intake system of the internal combustion engine to the fuel-vapor purging system by opening the purge control valve and the bypass valve and closing the pressure valve, a sealing process of sealing the interior of the fuel-vapor purging system by closing the purge control valve when the negative pressure is applied, and a differential-pressure releasing process of conducting outside air into the fuel-vapor purging system via the intake passage by opening the pressure valve and then closing the bypass valve;

first detection means for detecting a leak based on the behavior of the internal pressure of the fuel tank detected by the pressure sensor in a period between the sealing process and the differential-pressure releasing process, both or which are performed by the valve control means; and second detection means for detecting a failure in any of the valves based on the behavior of the internal pressure of the fuel tank detected by the pressure sensor in association with one or more of the differential-pressure forming process, the shielding process and the differential-pressure releasing process.

3. The failure test apparatus according to claim 2, wherein, when a change in the internal pressure of the fuel tank detected by the pressure sensor is out of a normal deceleration range in the differential-pressure forming process, the second detection means detects that at least one of the bypass valve, the pressure valve and the purge control valve is failing.

4. The failure test apparatus according to claim 2, wherein, when a change in the internal pressure of the fuel tank detected by the pressure sensor is out of a normal variation range in the sealing process or in a period immediately after the sealing process, the second detection means detects that the purge control valve is failing.

5. The failure test apparatus according to claim 3, wherein, when a change in the internal pressure of the fuel tank detected by the pressure sensor is out of a normal variation range in the sealing process or in a period immediately after the sealing process, the second detection means detects that the purge control valve is failing.

6. The failure test apparatus according to claim 2, wherein, when a change in the internal pressure of the fuel tank detected by the pressure sensor is out of a normal acceleration range when outside air is conducted into the fuel-vapor purging system with the pressure valve open in the differential-pressure releasing process, the second detection means detects that the pressure valve is failing.

7. The failure test apparatus according to claim 2, wherein, when a change in the internal pressure of the fuel tank detected by the pressure sensor is out of a normal deceleration range when the bypass valve is closed in the differential-pressure releasing process, the second detection means detects that the bypass valve is failing.

8. The failure test apparatus according to claim 2, wherein the fuel-vapor purging system further comprises:

a back purge passage for connecting the canister to the fuel tank and returning fuel vapor in the canister to the fuel tank; and a back purge valve to be opened when the internal pressure of the fuel tank is lower than the internal pressure of the canister by a predetermined pressure or by more than the predetermined pressure, wherein the back purge valve permits fuel vapor to flow into the fuel tank from the canister via the back purge passage.

9. The failure test apparatus according to claim 8, wherein the second detection means performs a first failure test for detecting that the pressure valve is failing when a change in the internal pressure of the fuel tank detected by the pressure sensor is out of a normal acceleration range when outside air is supplied into the fuel-vapor purging system when the pressure valve is open in the differential-pressure releasing process, and a second failure test for detecting that the bypass valve is failing when a change in the internal pressure of the fuel tank detected by the pressure sensor is out of a normal deceleration range when the bypass valve is closed in the differential-pressure releasing process.

10. The failure test apparatus according to claim 9, wherein the valve control means closes the bypass valve after a predetermined period from which the pressure valve is opened, wherein the predetermined period is set based on the internal pressure of the fuel tank detected by the pressure sensor.

11. The failure test apparatus according to claim 7, wherein the valve control means executes the differential-pressure forming process, the sealing process and the differential-pressure releasing process if the condition that variation in the internal pressure of the fuel tank detected by the pressure sensor lies within a tolerable range is satisfied when the bypass valve is closed.

12. The failure test apparatus according to claim 11, further comprising:

means for estimating variation in the internal pressure of the canister when the bypass valve is closed based on an amount of fuel vapor passing through the purge passage and judging that the bypass valve has failed based on whether there is a correlation between the estimated variation in the internal pressure of the canister and a variation in the internal pressure of the fuel tank; and execution enforcing means for executing the differential-pressure forming process, the sealing process and the differential-pressure releasing process by the valve control means even when the condition is not satisfied, when it is determination that the bypass valve has failed.

13. The failure test apparatus according to claim 2, wherein the second detection means detects that the pressure valve is not failing when a time-sequential pattern of second differential values of the internal pressure of the fuel tank detected by the pressure sensor has a positively protruding shape when outside air is conducted into the fuel-vapor purging system in the differential-pressure releasing process.

14. The failure test apparatus according to claim 2, wherein the second detection means detects that the bypass valve is not failing when a time-sequential pattern of second differential values of the internal pressure of the fuel tank detected by the pressure sensor has a negatively protruding shape when the bypass valve is closed in the differential-pressure releasing process.

15. A failure test method for a fuel-vapor purging system for adsorbing fuel vapor in a fuel tank into a canister and purging fuel in the canister to an intake system of an internal combustion engine as needed, the system having at least one valve, the method comprising:

first test step of providing a differential pressure between the inside and the outside of the fuel-vapor purging system, measuring the internal pressure with the fuel-vapor purging system when in an airtight condition and determining whether a leak exists in the fuel-vapor purging system from the behavior of the internal pressure, the determination by the first test step including a differential-pressure forming process of creating a differential pressure between the inside and the outside of the fuel-vapor purging system, a sealing process for making the fuel-vapor purging system airtight when the differential pressure exists, and a differential-pressure releasing process for releasing the differential pressure; and second test step of measuring the internal pressure of the fuel-vapor purging system in association with one or more of the processes to thereby detect a failure in the valve based on the behavior of the internal pressure.

16. The failure test method according to claim 15, wherein the valve is a pressure valve for opening or closing an intake passage that supplies outside air to the canister, wherein the method includes the step of detecting that the pressure valve is failing when a change in the internal pressure of the fuel tank detected by the pressure sensor is out of a normal acceleration range when outside air is conducted into the fuel-vapor purging system when the pressure valve is open and during the differential-pressure releasing process.

17. The failure test method according to claim 15, wherein the valve is a bypass valve for opening or closing a bypass passage that connects the fuel tank to the canister, wherein the method includes the step of detecting that the bypass valve is failing when a change in the internal pressure of the fuel tank detected by the pressure sensor is out of a normal deceleration range when the bypass valve is closed and during the differential-pressure releasing process.

18. The failure test method according to claim 15, wherein the valve is a pressure valve for opening or closing an intake passage that supplies outside air to the canister, wherein the method includes the step of detecting that the pressure valve is not failing when a time-sequential pattern of second differential values of the internal pressure of the fuel tank detected by the pressure sensor has a positively protruding shape when outside air is conducted into the fuel-vapor purging system in the differential-pressure releasing process.

19. The failure test method according to claim 15, wherein the valve is a bypass valve for opening or closing a bypass passage that connects the fuel tank to the canister, wherein the method includes the step of detecting that the bypass valve is not failing when a time-sequential pattern of second differential values of the internal pressure of the fuel tank detected by the pressure sensor has a negatively protruding shape when the bypass valve is closed in the differential-pressure releasing process.

* * * * *